US006088045A

United States Patent [19]

Lumelsky et al.

[11] Patent Number: 6,088,045

[45] **Date of Patent: *Jul. 11, 2000**

[54] HIGH DEFINITION MULTIMEDIA DISPLAY

[75] Inventors: Leon Lumelsky, Stamford, Conn.; Sung Min Choi, White Plains, N.Y.; Alan Wesley Peevers, Berkeley, Calif.; John Louis Pittas, Bethel, Conn.

[73] Assignee: International Business Machines Corporation, Armonk, N.Y.

[ * ] Notice: This patent is subject to a terminal disclaimer.

[21] Appl. No.: 07/733,950

[22] Filed: Jul. 22, 1991

[51] Int. Cl.[7] ..... G09G 5/36

[52] U.S. Cl. ..... 345/509; 345/516

[58] Field of Search ..... 340/721, 724, 340/814; 358/182, 183; 345/115, 121, 127, 200, 201, 189, 190, 192, 193, 185–213; 348/5

[56] References Cited

U.S. PATENT DOCUMENTS

| | | | |
|---|---|---|---|
| 3,904,817 | 9/1975 | Hoffman et al. . | |
| 4,360,831 | 11/1982 | Kellar | 358/183 |
| 4,528,561 | 7/1985 | Kitamura | 340/721 |
| 4,550,386 | 10/1985 | Hirosawa et al. | 364/900 |
| 4,574,279 | 3/1986 | Roberts | 340/731 |
| 4,631,588 | 12/1986 | Barnes et al. . | |
| 4,684,936 | 8/1987 | Brown et al. . | |
| 4,684,942 | 8/1987 | Nishi et al. | 340/701 |
| 4,710,762 | 12/1987 | Yamada | 340/721 |
| 4,742,474 | 5/1988 | Knierim . | |
| 4,761,642 | 8/1988 | Huntzinger . | |
| 4,774,583 | 9/1988 | Kellar et al. | 358/183 |
| 4,823,286 | 4/1989 | Lumelsky et al. . | |
| 4,890,257 | 12/1989 | Anthias et al. | 340/721 |
| 4,947,257 | 8/1990 | Fernandez et al. . | |
| 4,953,025 | 8/1990 | Saitoh et al. . | |
| 4,994,912 | 2/1991 | Lumelsky et al. . | |
| 5,061,919 | 10/1991 | Watkins | 340/721 |
| 5,091,717 | 2/1992 | Carrie et al. | 345/115 |
| 5,132,992 | 7/1992 | Yurt et al. | 348/5 |

*Primary Examiner*—Richard Hjerpe
*Assistant Examiner*—Chanh Nguyen
*Attorney, Agent, or Firm*—Perman & Green, LLP

[57] ABSTRACT

An image display system (10) includes an image buffer (20,22) having a plurality of addressable locations for storing image pixel data. The system further includes circuitry (24,34,36) coupled to an output of the image buffer for converting image pixel data read therefrom to electrical signals for driving an image display (18). The circuitry is responsive to signals generated by an image display controller (16) for generating one of a plurality of different timing formats for the electrical signals for driving an image display having a specified display resolution. The apparatus further includes circuitry (40,42) for configuring the image buffer in accordance with the specified display resolution. The image buffer is configurable, by example, as two, 2048 location by 1024 location by 24-bit buffers and one 2048 location by 1024 location by 16-bit buffer; or as two, 2048 location by 2048 location by 24-bit buffers and one 2048 location by 2048 location by 16-bit buffer. Each of the 24-bit buffers store R,G,B pixel data and the 16-bit buffers each store a color index (CI) value and an associated window identifier (WID) value. Circuitry at the output of the image buffer decodes CI and WID values into R,G,B pixel data and a Key value specifying pixel mixing.

33 Claims, 22 Drawing Sheets

| | INDEX n | FUNCTION |
|---|---|---|
| | X m n i | |
| *1 | SDQX(0-3)n0<7:0> # | SVSB<7:0> |
| *2 | SDQX(0-3)n0<15:8> # | SVSG<7:0> |
| *3 | SDQX(0,1)n1<7:0> # | SVSRA<7:0> |
| *4 | SDQX(2,3)n1<7:0> # | SVSRB<7:0> |
| *5 | SDQX(0,1)n1<15:8> # | WSCI<7:0> |
| *6 | SDQX(2,3)n1<15:8> # | WSWID<7:0> |

| FUNCTION |
|---|
| ADDRESS |
| STATUS |
| X-DATA |
| Y-DATA |

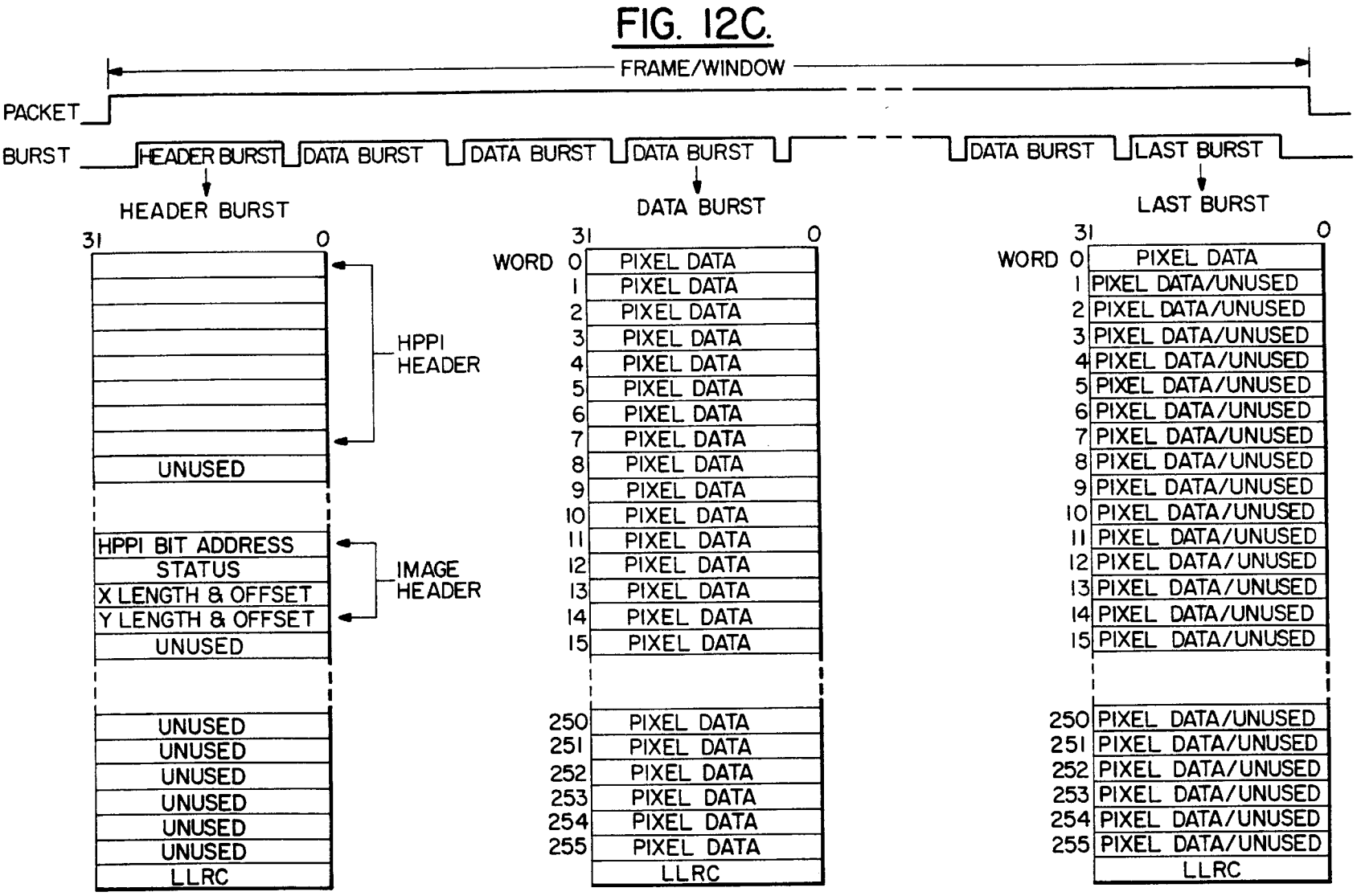
FRAME/WINDOW
PACKET
BURST
HEADER BURST
DATA BURST
DATA BURST
DATA BURST
DATA BURST
LAST BURST
HEADER BURST
31
0
HPPI HEADER
IMAGE HEADER
UNUSED
HPPI BIT ADDRESS
STATUS
X LENGTH & OFFSET
Y LENGTH & OFFSET
UNUSED
UNUSED
UNUSED
UNUSED
UNUSED
UNUSED
UNUSED
LLRC
DATA BURST
WORD
PIXEL DATA
PIXEL DATA
PIXEL DATA

SERIAL DATA PATH

HIGH DEFINITION MULTIMEDIA DISPLAY

CROSS REFERENCE TO RELATED PATENT APPLICATIONS

This patent application is related to the following commonly assigned U.S. patent applications: Ser. No. 07/734,432, filed Jul. 22, 1991 entitled "Scientific Visualization System", D. Foster et al.; Ser. No. 07/733,576, filed Jul. 22,1991, entitled "Look-Up Table Based Gamma and Inverse Gamma Correction for High-Resolution Frame Buffers" S. Choi et al.; Ser. No. 07/733,776, filed Jul. 22, 1991, entitled "Multi-Source Image Real Time Mixing and Anti-Aliasing" S. Choi et al.; Ser. No. 07/33,945, filed Jul. 22, 1991, entitled "A Point Addressable Cursor for Stereo Raster Display" L. Cheng et al.; Ser. No. 07/734,383, filed Jul. 22, 1991, entitled "Communication Apparatus and Method for Transferring Image Data from a Source to One or More Receivers" S. Choi et al.; Ser. No. 07/733,944, filed Jul. 22, 1991, entitled "Frame Buffer Organization and Control for Real-Time Image Decompression" S. Choi et al. Ser. No. 07/733,906, filed Jul. 22, 1991, entitled "Video Ram Architecture Incorporating Hardware Decompression", S. Choi et al.; and Ser. No. 07/733,768, filed Jul. 22, 1991, entitled "Compressed Image Frame Buffer for High Resolution Full Color, Raster Displays".

FIELD OF THE INVENTION

This invention relates generally to image display systems and, in particular, to high resolution, multi-image source display systems.

BACKGROUND OF THE INVENTION

Contemporary supercomputer technology is often employed for the visualization of large data sets and for processing of real-time, high resolution images. This requires large image data storage and control capability coupled with the use of high resolution monitors, and high resolution motion color images that are sampled in real-time.

Many present-day supercomputers do not include a display controller. A workstation which controls a user interface with a supercomputer typically includes a graphics controller, but can display only those images generated within the workstation.

There is thus a need for a display controller separate from a supercomputer and the controlling workstation for visualizing and combining supercomputer output data, and/or high definition television (HDTV) input, on a very high resolution screen under a workstation user's control.

Requirements for such a display controller include an ability to process a variety of image or graphics visuals, an ability to accommodate a variety of screen resolutions, television standards, image sizes, and an ability to provide color control and correction. By example, the display controller should accommodate full motion video real-time animated images, still images, text and/or graphics. These images may be represented in different formats, such as RGB, YUV, HVC, and color indexed images. Different display resolutions may also need to be accommodated, such as 1280×1024 pixels for graphics image and 1920×1035 lines for HDTV. Finally, there may be a requirement to show a stereoscopic image, which consists of left and right views, that is shown at twice the speed of a normal non-stereo, or planar, image.

One problem arises when a monitor is required to display image data from a variety of sources, wherein the monitor may have a resolution different from any of the image data sources. Further complicating the display is a requirement that diverse images be video refreshed synchronously, and have a common final representation, such as RGB.

Another problem is that visuals originate from different sources, such as a television camera, a very high speed supercomputer interface, and a slower interface with the workstation host processor. It is clear that the interfaces of the multimedia display to these sources, and their data structures, are specific, but they must also coexist. For example, providing maximum throughput for a supercomputer data path must not interfere with a television data stream, in that television images cannot be delayed without losing information.

A further problem is that to overlay a plurality of diverse images is a complicated process. Simple pixel multiplexing becomes complicated in a multitasking environment, where different images and their combinations must be treated differently in different application windows.

One possible solution to these diverse problems is derived from an approach used by a variety of known multimedia display controllers. This solution treats each image source separately and stores the data of each source in a separate frame buffer. Each frame buffer may have different dimensions, that is, resolution and number of bits per pixel. All of the frame buffers are then refreshed synchronously. As can be realized, such a system is expensive and requires a complicated, high performance video data path, where all possible image combinations must be handled. Although this conventional approach may be referred to as "modular", it lacks the integration required for a truly equal functional treatment of all images from the user's point of view. Furthermore, the amount of memory required to realize the different frame buffers may be much larger than actually needed to store the images. That is, due to fixed memory chip organizations and capacities, and the diversity of image representations and formats, an inefficient use of memory may result, requiring more memory chips or modules than that actually required to store a given image.

In commonly assigned U.S. Pat. No. 4,994,912, issued Feb. 19, 1991, entitled "Audio Video Interactive Display" to Lumelsky et al. there is described method and apparatus for synchronizing two independent rasters such that a standard TV video and a high resolution computer generated graphics video may each be displayed on a high resolution graphics monitor. This is achieved through the use of dual frame buffers, specifically a TV frame buffer and a high resolution frame buffer. A switching mechanism selects which of the TV video and the high resolution graphics video is to be displayed at a given time. The graphics data is combined with the TV video for windowing purposes.

In commonly assigned U.S. Pat. No. 4,823,286, issued Apr. 18, 1989, entitled "Pixel Data Path For High Performance Raster Displays with All-Point-Addressable Frame Buffers" to Lumelsky et al. there is described a multichannel data path architecture which assists a host processor in communicating with a frame buffer. FIGS. 12, 13, and 14 illustrate a plane mode, a slice mode, and a pixel mode format which are related to the organization of the addressing of the frame buffer.

In commonly assigned U.S. Pat. No. 4,684,936, issued Aug. 4, 1987, entitled "Displays Having Different Resolutions For Alphanumeric and Graphics Data" to Brown et al. there is described a display terminal that presents alphanumeric and graphic data at different resolutions simultaneously. The durations of the individual alphanumeric and graphic dots have a fixed but non-integral ratio to each other, and are mixed together asynchronously to form a combined video signal to a CRT.

In U.S. Pat. No. 4,947,257, issued Aug. 7, 1990, entitled "Raster Assembly Processor" to Fernandez et al. there is described a raster assembly processor that receives a plurality of full motion video and still image input signals and assembles these signals into a full bandwidth color component, high resolution video output signal in standard HDTV format (i.e. NHK-SMPTE 1125-line HDTV format). A multi-media application is organized into a plurality of overlapping windows, where each window may comprise a video or a still image. A single multiported memory system is utilized to assemble the multi-media displays. Raster data is read out of the memory through a multiplexer that combines the signals present on a plurality of memory output channels into an interlaced 30 frame/second HDTV signal. A key based memory access system is used to determine which pixels are written into the memory at particular memory locations. Video and still image signal pixels require four bytes, specifically, Red (R), Green (G), and Blue (B) color component values and a key byte, the key byte containing a Z (depth) value. This patent does not address the storage of a high definition video signal or the storing and display of two real time images. Also, the provision of a multi-resolution display output is not addressed. Furthermore, the key data byte is employed for enabling memory write operations and, as a result, after the video is stored, the image within the window is fixed.

In U.S. Pat. No. 4,761,642, issued Aug. 2, 1988, entitled "System For Providing Data Communication Between A Computer Terminal And A Plurality of Concurrent Processes Running on a Multiple Process Computer" to Huntzinger there is described a system that allows a single computer to simultaneously run several processes and show the output of each process in a correspondent display screen window selected from a plurality of windows. Software includes a screen process for maintaining a subrectangular list comprising a set of instructions for allocating window portions of the screen to the displays defined by separate display lists.

In U.S. Pat. No. 4,953,025, issued Aug. 28, 1990, entitled "Apparatus For Defining an Effective Picture Area of a High Definition Video Signal When Displayed on a Screen With A Different Aspect Ratio" to Saitoh et al. there is described an apparatus for changing a video input aspect ratio. Specifically, a HDTV video signal is digitized, stored within a memory, and displayed on the picture screen of an NTSC or other conventional television monitor receiver having an aspect ratio that differs from that of the HDTV format.

In U.S. Pat. No. 4,631,588, issued Dec. 23, 1986, entitled "Apparatus and Its Method For The Simultaneous Presentation of Computer Generated Graphics And Television Video Signals" to Barnes et al. there is described a method for generating a graphic overlay on a standard video signal. The resulting video has the same resolution and timing as the incoming video signal.

In U.S. Pat. No. 3,904,817, issued Sep. 9, 1975, entitled "Serial-Scan Converter" to Hoffman et al. there is described a scan-converter display for operating with a variety of radar sweep signals or a variety of television raster sweep signals. A serial main memory is used for refreshing the display at a rate much higher than a radar data acquisition rate. A sweep format of a common display is altered so as to accommodate video from a variety of sources of different video formats.

What is not taught by these patents, and what is thus one object of the invention to provide, is a multimedia display for storing and displaying a plurality of real time images, and which furthermore enables the use of a plurality of programmable output video resolutions.

It is another object of the invention to provide a novel frame buffer organization so as to achieve an efficient use of memory devices.

It is a further object of the invention to provide for the display of image data from a plurality of image sources, including a plurality of real time image sources, with a single frame buffer.

It is another object of the invention to provide a video image storage format wherein a pixel includes R, G, B data and associated key data, the key data being used for controlling an output video data path and enabling the display of stored video images to be altered.

SUMMARY OF THE INVENTION

The foregoing and other problems are overcome and the objects of the invention are realized by image display apparatus that includes an image buffer having a plurality of addressable locations for storing image pixel data and circuitry, having an input coupled to an output of the image buffer, for converting image pixel data read therefrom to electrical signals for driving an image display. The circuitry is responsive to signals generated by an image display controller for generating one of a plurality of different timing formats for the electrical signals for driving an image display having a specified display resolution. The apparatus further includes circuitry, responsive to signals generated by the image display controller, for configuring the image buffer in accordance with the specified display resolution.

The image buffer is configurable, by example, as two, 2048 location by 1024 location by 24-bit buffers and one 2048 location by 1024 location by 16-bit buffer; or as two, 2048 location by 2048 location by 24-bit buffers and one 2048 location by 2048 location by 16-bit buffer; or as four, 2048 location by 1024 location by 24-bit buffers and two 2048 location by 1024 location by 16-bit buffers. Each of the 24-bit buffers store R,G,B pixel data and the 16-bit buffers each store a color index (CI) value and an associated window identifier (WID) value received from the image display controller. Circuitry at the output of the image buffer decodes a CI value and an associated WID value to provide R,G,B pixel data.

The apparatus further includes a first interface having an input for receiving image pixel data expressed in a first format and an output coupled to the image buffer for storing the received image pixel data in a R,G,B format. The first interface may be coupled, by example, to a supercomputer for receiving 24-bit R,G,B image pixel data therefrom.

The apparatus further includes a second interface having an input for receiving image pixel data expressed in a second format and an output coupled to the image buffer means for storing the received image pixel data in a R,G,B format. The second interface is coupled to a source of HDTV image data and includes circuitry for sampling the HDTV analog signals and for converting the analog signals to 24-bit R,G,B data.

A third interface is coupled to the image display controller, specifically the data bus thereof, for receiving image pixel data expressed in the CI and WID format.

The CI value and the associated WID value are decoded, after being read from the image buffer, to provide a key signal specifying, for an associated image pixel, a contribution of the R,G,B data from the first interface, a contribution of the R,G,B data from the second interface, and a contribution of the R,G,B, data decoded from the CI and WID values.

BRIEF DESCRIPTION OF THE DRAWING

The above set forth and other features of the invention are made more apparent in the ensuing Detailed Description of the Invention when read in conjunction with the attached Drawing, wherein:

FIG. 12*c* illustrates an adaptation made by the system of the invention to the HPPI data format of FIG. 12*b;*

DETAILED DESCRIPTION OF THE INVENTION

Figure 1:
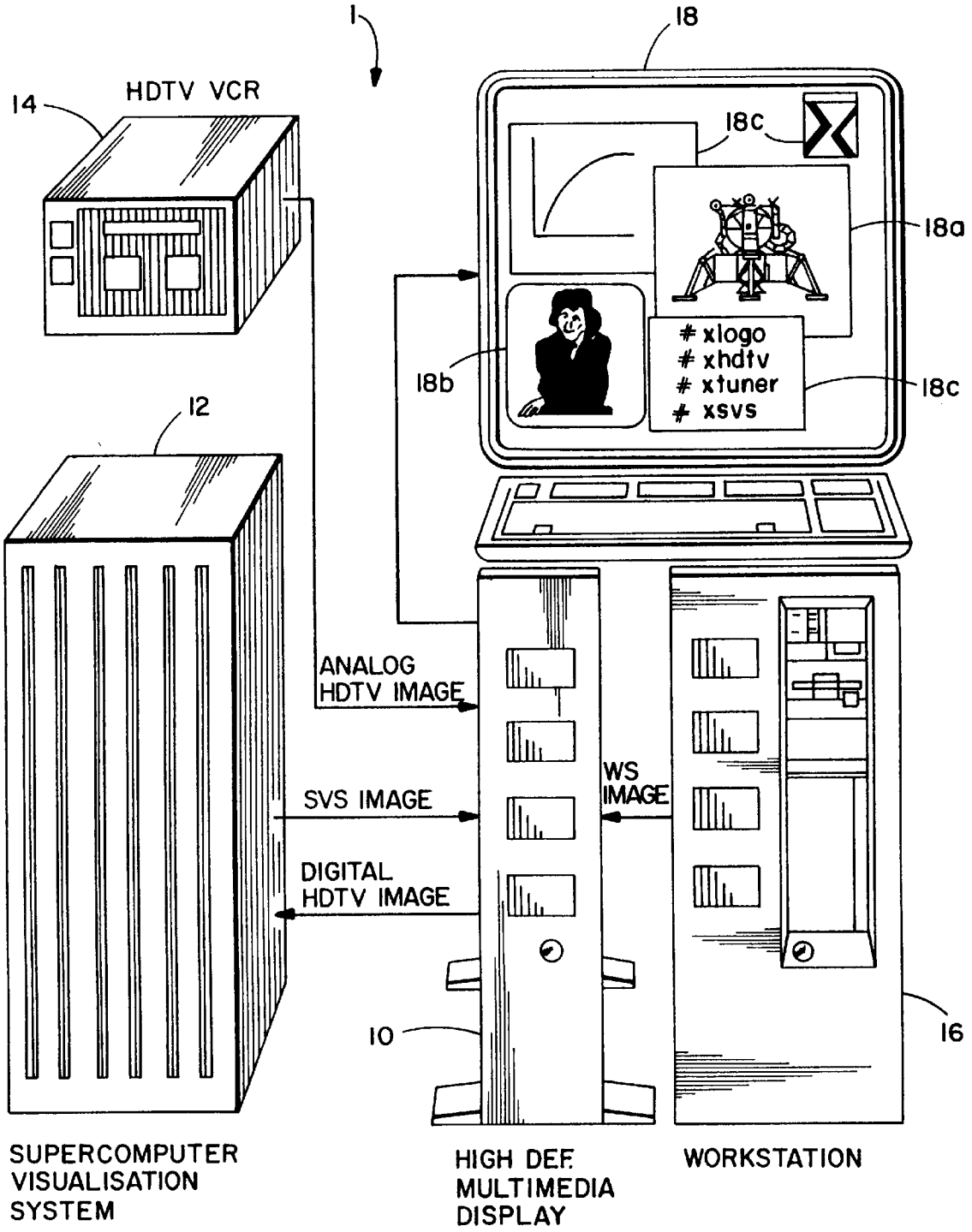
FIG. 1 is a block diagram of an image display system that includes a High Definition Multimedia Display (HDMD)

Referring to FIG. 1 there is shown an illustrative embodiment of the invention. A High Definition Multimedia Display controller (HDMD) 10 receives image data from a supercomputer visualization system (SVS) 12, a HDTV source 14, and a workstation 16, and sends sampled HDTV image back to a supercomputer via the SVS 10. The HDMD 10 also serves display monitors 18, which may be provided with differing resolutions. As employed herein, a medium resolution monitor is considered to have, by example, 1280 pixels by 1024 pixels. A high resolution monitor is considered to have, by example 1920 pixels by 1536 pixels or 2048 pixels by 1536 pixels. HDTV resolution is considered to be 1920 pixels by 1035 pixels. An example of the screen content of monitor 18 shows a supercomputer synthesized image 18*a*, a HDTV image 18*b*, and user interface (workstation) images 18*c* each in a different, overlapping window. The workstation 16 may or may not include its own monitor, depending on the user's preference, in that the user interface may run directly on the HDMD monitor 18. The workstation 16 interface may be a plug-in board in the workstation 16, which provides the required electrical interface to the HDMD 10. In a preferred embodiment this interface conforms to one known as Microchannel. In general, any workstation or personal computer may be used for a user interface with a suitable HDMD 10 interface circuit installed within the workstation. As such, the circuitry of the HDMD 10 functions as an addressable extension of the workstation 16.

By way of introduction, the HDMD 10 includes the following features, the implementation of which will be described in detail below.

The HDMD 10 Frame Buffer architecture is reconfigurable to accommodate different user requirements and applications. These include a requirement to provide very high resolution, full color supercomputer images, such as 2048 pixels by 1536 pixels by 24-bits, doubled buffered; a requirement to support both supercomputer and HDTV full color images, with a full speed background overlay through the use of two, 2048 pixel by 1024 pixel buffers (one double buffered); a requirement to provide only HDTV or only supercomputer medium resolution image display with graphics overlay with 2048 pixel by 1024 pixel by 24-bits (double buffered) and 2048 pixel by 1024 pixel by 16-bit graphics from the workstation; a requirement to provide an interlaced HDTV input and a very high resolution, non-interlaced output; and a requirement to support a stereoscopic (3-dimensional image) output.

An open-ended architecture approach enables expansion of a HDMD frame buffer to satisfy appropriate image storage and input and output bandwidth requirements, without functional changes. As a result, the user may define monitors with different screen resolutions, different frame sizes, format ratios, and refresh rates.

The user may also preprogram video synchronization hardware in order to use different monitors or projectors and accommodate future television standards and various communication links.

The architecture also provides simultaneous display of full color, real-time sampled HDTV data and SVS processed video data on the same monitor. To this end the HDMD 10 provides synchronization of a fast supercomputer image with the local monitor 18 attached to the frame buffer, thus eliminating motion artifacts due to variable frame rates of data received from a supercomputer.

The HDMD 10 also provides sampling and display of HDTV video. Reprogrammable synchronization and control circuitry enables different HDTV standards to be accommodated.

The HDMD 10 also provides a digital output of sampled HDTV data to an external device, such as a supercomputer, for further processing. A presently preferred communication link is implemented with an ANSI-standard High Performance Parallel Interface (HPPI).

The HDMD 10 also supports multitasking environments, allowing the user to run several simultaneous applications.

By example the user may define application windows and the treatment of internal and external images in the defined windows. The user also controls HDTV image windowing and optional hardware scaling.

The HDMD 10 memory architecture furthermore accommodates very high density video RAM (VRAM) devices, thereby reducing component count and power consumption.

Figure 2:
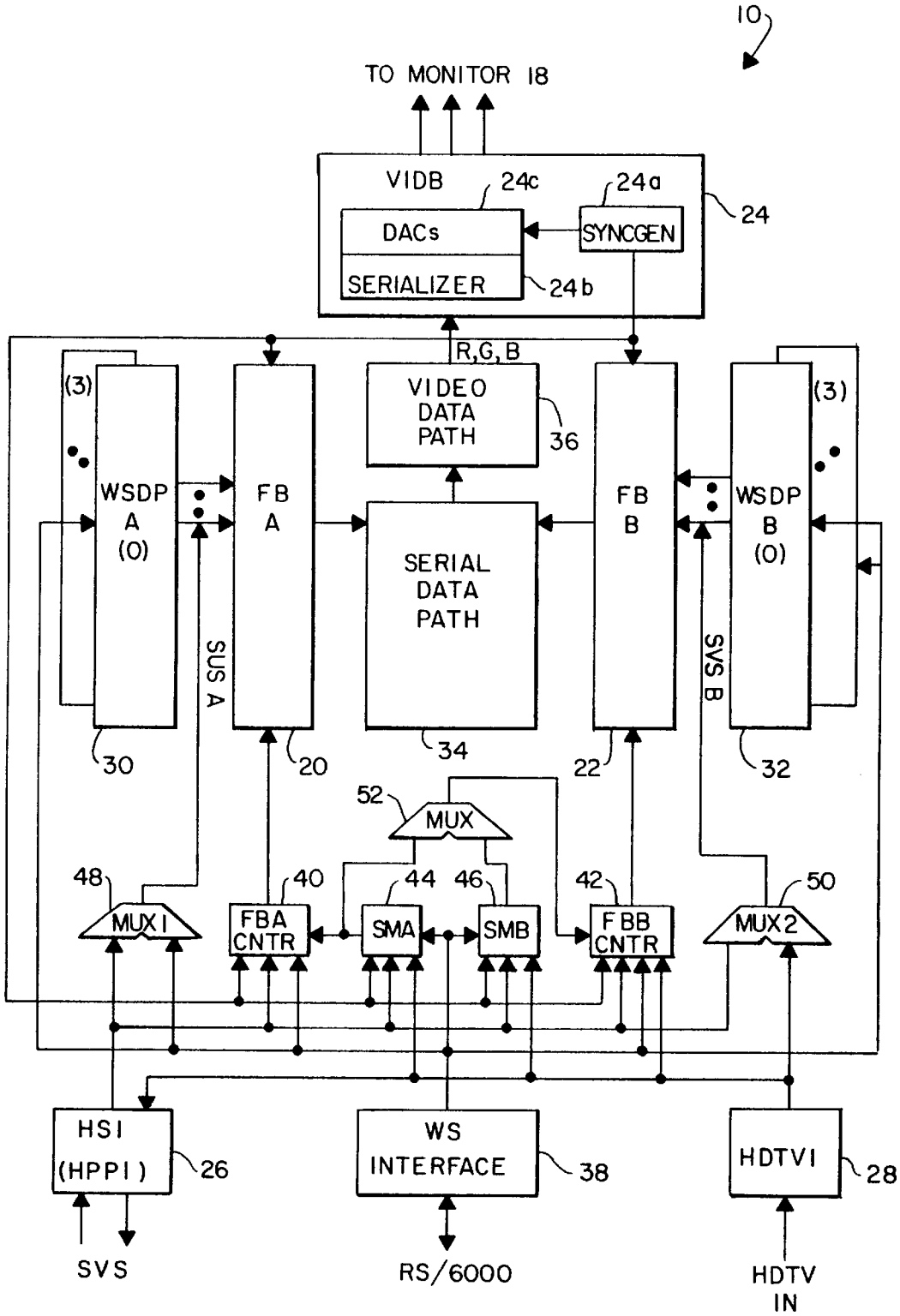
FIG. 2 is an overall block diagram of the HDMD showing major functional blocks thereof.

Referring now to FIG. 2 there is shown an overall block diagram of the HDMD 10. The HDMD 10 includes six major functional blocks. Five of the blocks are implemented as circuit boards that plug into a planar. The major blocks include two Frame Buffers memories (FBA) 20 and (FBB) 22, a video output board (VIDB) 24, a high speed interface board (HSI) 26, and a high definition television interface (HDTVI) 28. One FB and the VIDB 24 are required for operation. All other plug-in boards are optional and may or may not be installed, depending on the system configuration defined by a user.

A Workstation Data Path (WSDP) device A 30 and B 32, a Serial Data Path device 34, a Video Data Path device 36, a workstation (WS) interface device 38, two Frame Buffer controllers FBA CNTR 40 and FBB CNTR 42, and two state machines SMA 44 and SMB 46, are physically located on the planar and fulfill common display control and data path functions.

The HSI 26 provides an interface with the SVS 12 and passes SVS 12 images directly to the FBA 20 and/or FBB 22. The HSI 26 also receives sampled video data from the HDTVI 28 and passes the sampled data to the svs 12 for further processing.

The FBA 20 and FBB 22 are implemented using dual port VRAMs of a type known in the art. A primary port of each FB receives data from the SVS 12 or the HDTVI 28, via multiplexers 48 and 50, or data from WSDPA 30 or WSDPB 32. A secondary port of each FB shifts out four pixels in parallel to the Serial Data Path 34. The shift-out clock is received from a VIDB 24 synchronization generator (SYNCGEN) 24*a* and is programmable, depending on a required screen resolution, up to a 33 MHz maximum frequency. Thus, one FB provides up to a 132 MHz (4 pixels×33 MHz) video output, and two FBS provide up to a 264 MHz (8 pixels×33 MHz) output. The latter frequency corresponds to a $3\times10^6$ pixel, 60 Hz, non-interlaced video output.

The Serial Data Path 34 combines the FBA 20 and FBB 22 serial outputs representing a 24-bit red, green, and blue (RGB) SVS image, a 16-bit color WS 16 image, and multiwindow control codes. The Video Data Path 36 implements multiwindow control functions for image overlay. The output of the Video Data Path 36 provides R, G, B digital data for four or eight pixels in parallel, and passes the pixel data to the VIDB 24 serializers 24*b*.

A primary function of the VIDB 24 is to display images stored in one or both FBs 20, 22. The serialized digital outputs of the Video Data Path 36 are applied to high performance DAC's 24*c* for conversion to analog red, green and blue monitor 18 inputs. In addition, VIDB 24 provides video synchronization to the secondary ports of the FBs 20, 22. The SYNCGEN block 24*b* supplies a video clock to the DACs 24*c*, and video and memory refresh requests to the state machines SMA 44 and SMB 46.

The HDTVI 28 functions as a HDTV video digitizer and scaler and as a source of image data for one or both FBs 20, 22. In addition, it reformats its digital video output to be transmitted back to the SVS 12 through a HPPI output port of the HSI 26.

The FBA 20 and FBB 22 are controlled by the FBA CNTR 40 and FBB CNTR 42, respectively, and the state machines SMA 44 and SMB 46, respectively. The state machines generate signals to execute memory cycles and also provide arbitration between HPPI, SYNCGEN 24*a*, and WSDP 30, 32 bus requests. If both HDTV and SVS image sources are used, the state machines work independently. If HDTV-only or SVS-only sources are used, the state machine SMA 44 controls both FBs 20, 22 in parallel, via multiplexer MUX 52.

The FBA CNTR 40 and FBB CNTR 42 provide all addresses and most memory control signals for the FBs 20, 22. Each receives timing control from the SYNCGEN 24*a* and SVS and HDTV image window coordinates from the HSI 26 and HDTVI 28, respectively.

The WS interface 38 provides the user with access to all control hardware, and to the Frame Buffers 20, 22. It also provides a signal to SMA 44 and SMB 46 indicating a workstation request.

As illustrated in FIG. 2, there are two multiplexors in the data path. Multiplexor MUX1 48 allows an incoming image from the HSI 26 to be written in both FBs 20, 22. Multiplexor MUX2 50 allows HDTV images to be written in both FBs 20, 22. The former mode of operation enables a supercomputer image to be displayed on a high resolution monitor, and the latter mode of operation enables a HDTV image to be displayed on a high resolution, noninterlaced monitor. A third mode enables an output of a medium resolution image in a stereoscopic 3D mode. In this third mode, the image is treated as a high resolution image, and is written to both FBA 20 and FBA 22. The data from both FBs is sent to the serial data path 34 with a vertical frequency of 120 Hz, and with a 240 MHz video pixel clock. The same approach may be employed to display a stereoscopic HDTV image rendered by an external data processor, such as a supercomputer.

Based on the foregoing, possible configurations and applications of the HDMD 10 include the following.

The HDMD 10 may be operated in a medium resolution output, SVS-only input mode. One FB and the HSI 26 are required. Applications include supercomputer-only graphics on a medium resolution or a HDTV standard display monitor. For example, images may be displayed and modified on a non-interlaced medium resolution screen, and stored frame by frame on a supercomputer disk array. The stored image may then be read back from the supercomputer disk array to the FB, displayed by the VIDB 24 operating in HDTV mode, and recorded on a HDTV tape recorder in real time, e.g. 30 frames/sec., thus providing smooth motion video.

The HDMD 10 may also be operated in a high resolution output, SVS-only input mode. Both the FBA 20 and the FBB 22 and the HSI 26 are required. The input HPPI data is written to both FBs 20 and 22. In this mode of operation the HDMD 10 is used for supercomputer-only graphics and high resolution imaging.

The HDMD 10 may also be operated in a medium resolution, SVS and HDTV input mode. Both FBS 20 and FBB 22, the HSI 26, and the HDTVI 28 are required. Sampled HDTV frames are sent fully or partially back to the supercomputer through HSI 26, and also to the monitor 18 through the FBB 22. The image, as processed by the supercomputer, is sent back to the FBA 20 for storage. Both images thus coexist in separate or overlapping windows on the same monitor 18, providing convenient access to both an unprocessed and a processed video source.

The HDMD 10 may also be operated in a high resolution output, HDTV-only input mode. Both the FBA 20 and the FBB 22, and the HDTVI 28 are required. An interlaced HDTV image is shown on a very high resolution monitor 18 operating in a non-interlaced mode. An advantage of this mode of operation is that the very high resolution monitor 18 provides 30 per cent more screen area than the HDTV resolution requires. This additional screen area may be used for user interface text or graphics from WS 16.

The HDMD 10 may also be operated in a stereoscopic output mode. Both the FBA 20 and the FBB 22, and the HSI 26 or the HDTVI 28 are required to display either a medium resolution or HDTV stereoscopic image. Both FBs 20 and 22 are required in order to double the video bandwidth, providing a wider serial data path. Hence, in the stereoscopic mode, one half of the available FB memory is not used for image storage.

Having described the general construction of the HDMD 10, and having provided several examples of its use, each of the functional blocks of FIG. 2 is now described in further detail.

FBA 20, FBB 22

Figure 3:
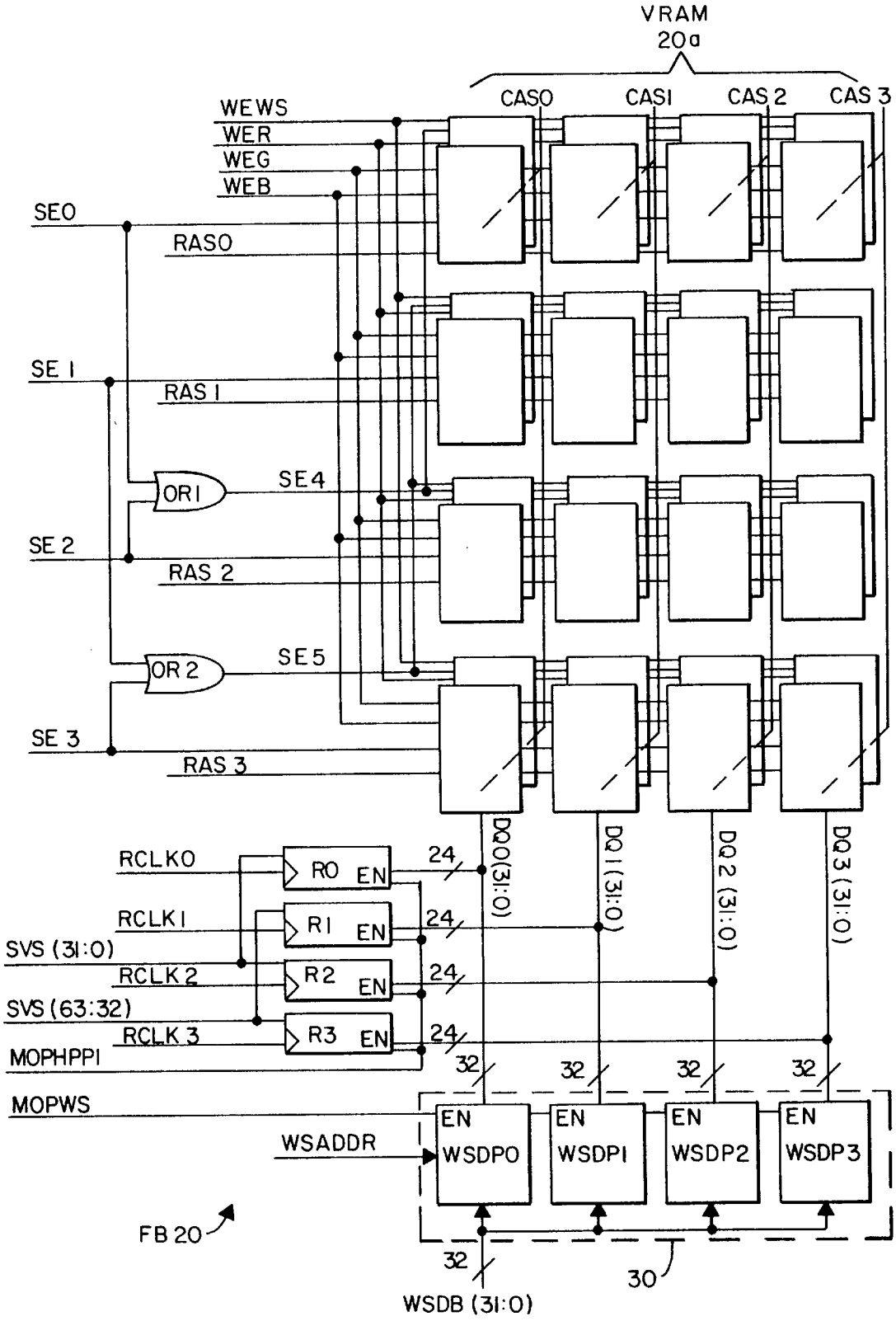
FIG. 3 is a block diagram showing one of the frame buffers (FB)

FIG. 3 depicts the FBA 20, it being realized that the FBB 22 is identically constructed. The FBA 20 stores 128 Mbits ($128\times10^6$ bits) of data and includes 32, 4-Mbit VRAM devices 20*a*. Each VRAM 20*a* is organized as 256K words by 16-bits per word. The I/O pins of the VRAMs 20*a* are connected vertically, providing four, 32-bit data paths DQ0–DQ3. The lower 24 bits of these data paths are coupled to one of four pipeline registers R0–R3, which in turn are loaded from a 64-bit SVSA bus by four clock pulse sequences RCLK0–RCLK3. Each of the 32-bits of each data path DQ0–DQ3 is also coupled to one of four bi-directional workstation data path devices 30 (WSDP0–WSDP3).

As was noted previously, the supercomputer image employs a dual buffer FB for storing two 24-bit data words for each screen location. Also, the WS 16 image requires 16-bits per pixel, where 8-bits are a color index (CI) value (converted further to 24 bits using video look-up tables), and 8-bits represent a pixel attribute, or display screen window identification (WID) number. The dual FB mode is not required for the WS 16 data, since WS performance is generally too low to deliver motion images.

In accordance with a convention used herein, the VRAMS 20*a* are designated FBxmni, where x=A for FBA 20, x=B for FBB 22, m is a row number equal to 0, 1, 2, or 3, n is a column number equal to 0, 1, 2, or 3, and i is a VRAM number in the z-direction (front=0 and back=1). Thus, FBxOni refers to the eight VRAMs in the upper row of either frame buffer. FBxmOi refers to the eight VRAMs in the left-most column of either frame buffer; FBAm0 refers specifically to the 8 VRAMs in the left-most column of FBA 20; and FBB231 refers to the VRAM located in FBB 22, the second row, third column, in a rear "slice".

Figure 4:
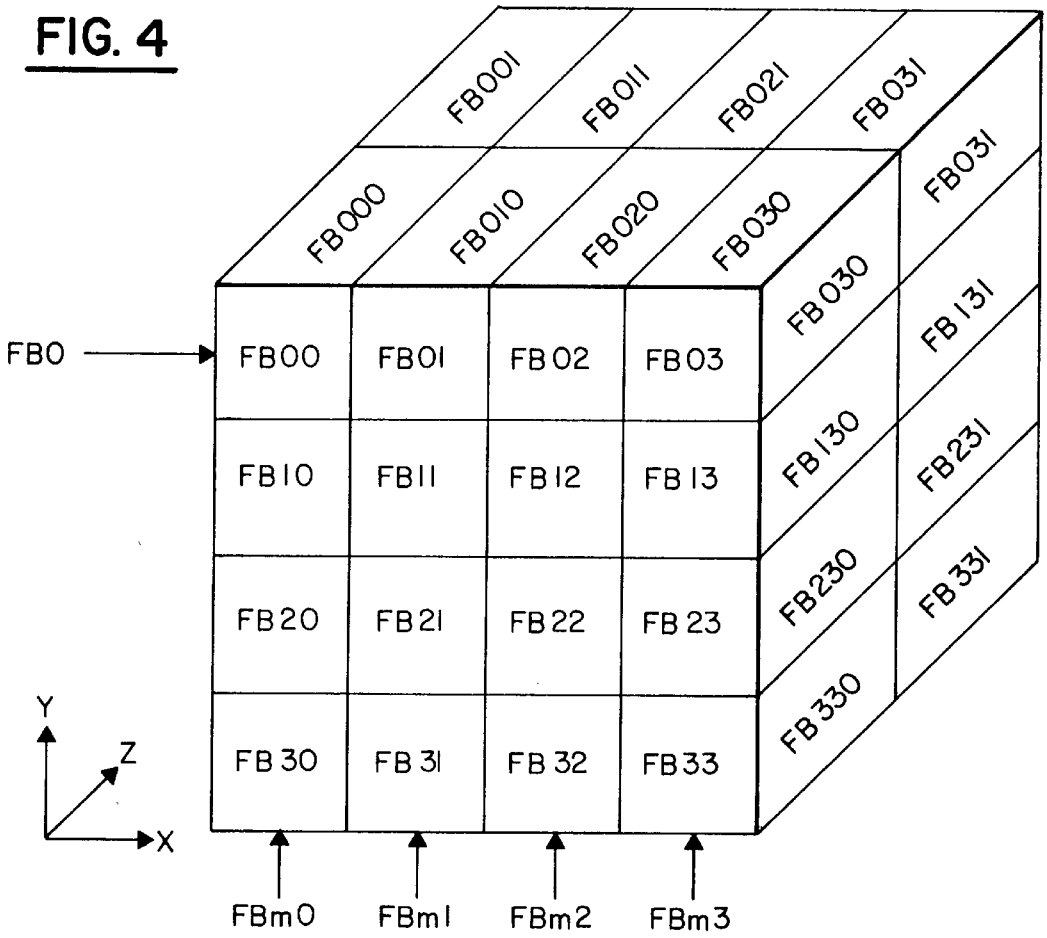
FIG. 4 depicts a memory architecture of each FB configured as a single block of 2K×2K×32 bits and organized in a three-dimensional 4×2 array of VRAMs.

The organization shown in FIG. 4 substantially reduces the data and video path bit-width. In addition, it minimizes the number of control signals. It should be realized that such a FB may also be used as a 2K×2K×32 bit general purpose memory.

However, in accordance with an object of the invention, there is provided a Frame Buffer that is configured as two, 2048 location by 1024 location by 24-bit buffers and one 2048 location by 1024 location by 16-bit buffer; or as two, 2048 location by 2048 location by 24-bit buffers and one 2048 location by 2048 location by 16-bit buffer; or as four, 2048 location by 1024 location by 24-bit buffers and two 2048 location by 1024 location by 16-bit buffers; wherein the 24-bit buffers store R,G,B pixel data and the 16-bit buffers store the CI and the WID data.

Figure 5A:
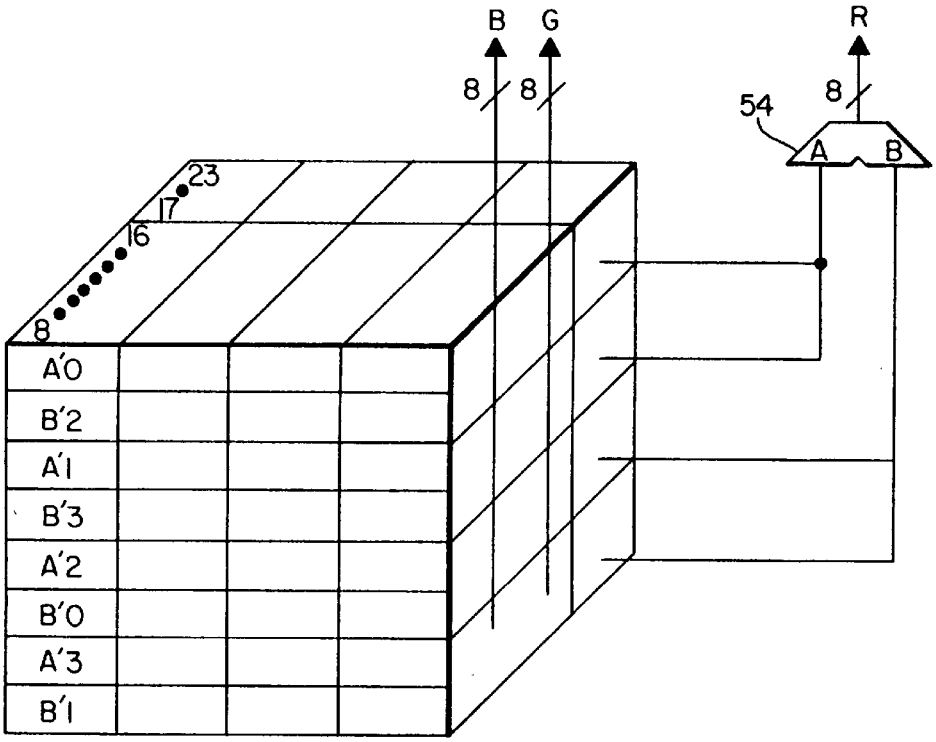
FIG. 5*a*, shows the FB organized as two, 16 VRAM slices, vertically oriented in the drawing.

Referring to FIG. 3 and FIG. 5*a*, it can be seen that the FBA 20 may be considered as having two, 16 VRAM slices, vertically oriented in the drawing. The front slice has I/O pins numbered as (0:16) and stores the lower 16-bits of the 24-bit SVS image. The rear slice is represented by two portions. One portion has I/O pins numbered as (17:23), and stores the upper 8-bits of the 24-bit SVS image. The second portion of the rear slice is shown in separately in FIG. 5*b* and stores the 16-bit WS 16 image data as 8-bits of CI and 8-bits of WID for each WS 16 pixel.

As was said previously, for the medium resolution case the SVS image is stored as a 2K×1K double-buffered image. If two buffers, not to be confused with the Frame Buffer A 20 and the Frame Buffer B 22, are designated as buffers A' and B', then the SVS image is stored as shown in FIG. 5*a*, where lines 0, 1, 2, 3 of buffer A' have a row address of 0 in all VRAMs, and are stored in the FB0, FB1, FB2, FB3 slices, respectively, while lines 0, 1, 2, 3 of buffer B' have a row address of 256 in all VRAMs, and are stored in the FB2, FB3, FB0, FB1 slices, respectively. Lines 5, 6, 7, 8 have row addresses incremented by one relative to lines 0, 1, 2, 3, etc.

Figure 5B:
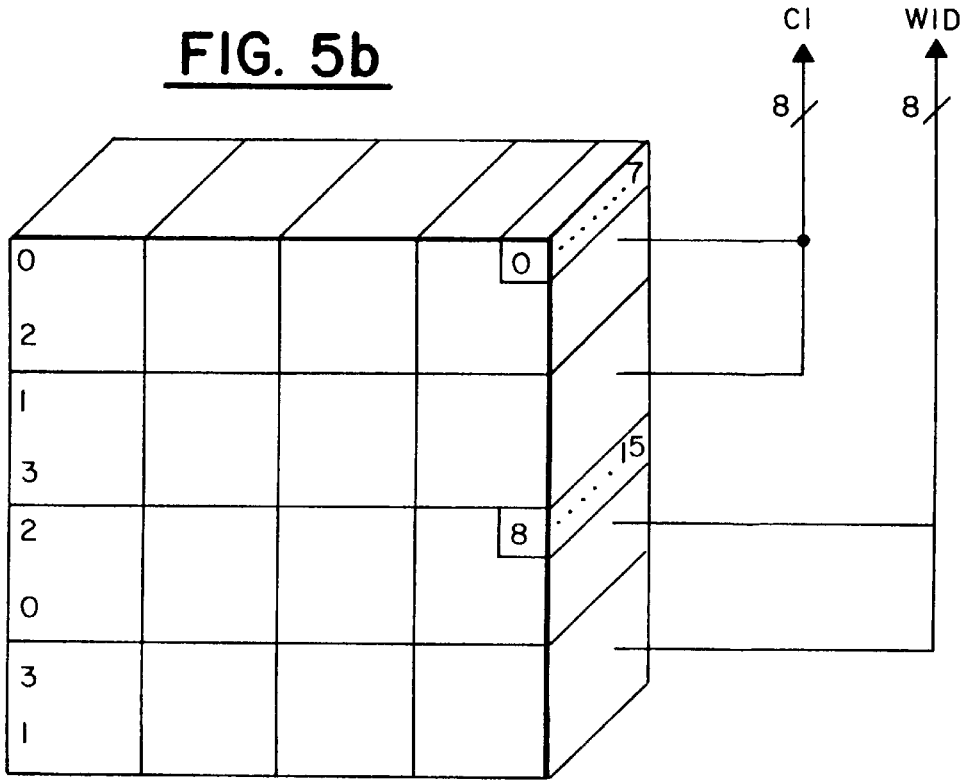
FIG. 5*b* depicts a workstation display line order.

The WS 16 line order is shown in FIG. 5*b*. Line 0 of the color index (CI) data (bits (0:7) of the WS image pixels is stored in the upper row of VRAMs having memory row address 0. Line 0 of the window identification number (WID) (bits (8:15) of the WS image pixels) is stored in the third row of VRAMs with row address 256. Line 1 of CI data is stored in the second row with memory row address 0, and line 1 of WID data is stored in the fourth row of VRAMs with memory row address 256, etc. Line 5 data is stored in the same rows of the VRAMs with memory row addresses incremented by four relative to line 0, etc.

This novel line/address distribution technique provides a reduction in a required width of the Serial Data Path 34. This technique of image line distribution also permits the majority of VRAM serial input/output bits to be connected and thus significantly improves the efficiency of VRAM utilization. A total of 16 conductors in each column are multiplexed by means of eight, 2-to-1 multiplexors 54. As a result, each column's serial output supplies 40 bits of R, G, B, CI and WID data.

Figures 6A, 6B:
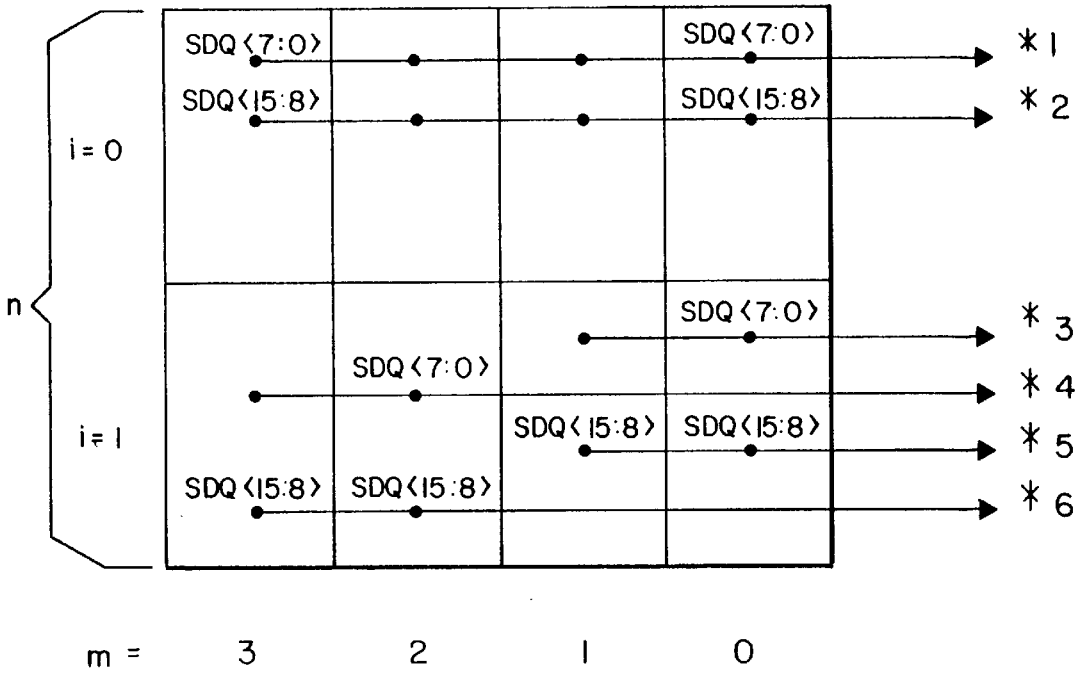
FIG. 6*a* illustrates the VRAM secondary port data bits SDQ.
FIG. 6*b* illustrates four of the buses that serve as 8-bit FB color components.

To further explain the organization of the serial output, FIG. 6*a* illustrates the VRAM secondary port output data bits SDQ, and specifically shows the SDQ connections for the eight VRAMs in column 'n'. The FBmn0 VRAMs have SDQ connected bit-wise, providing a 16 wire serial output. Connected are SDQ bits (7:0) for FBx0n1 and FBx1n1, bits (7:0) for FBx2n1 and FBx3n1, bits (15:8) for FBx0n1 and FBx1n1, and bits (15:8) for FBx2n1 and FBx3n1. There are thus a total of six, 8-bit serial data buses. As seen in FIG. 6*b* four of the buses serve as 8-bit FB color components: SVSBn<7:0> for blue, SVSGn<7:0> for green, and SVSRAn<7:0> and SVSRBn<7:0> for the red color. The red bits are multiplexed based on two bits of a video refresh address, providing the SVS Red component. The multiplexer 54 (FIG. 5*b*) eliminates serial bus contention in that, for every video line, the serial outputs of two rows of the FB chips are enabled to provide the WID and CI outputs of the WS image. As a result, the red portion of the 24-bit SVS image is enabled simultaneously for two lines, since the red information is stored in the same FB portion as CI and WID.

Figure 7A:
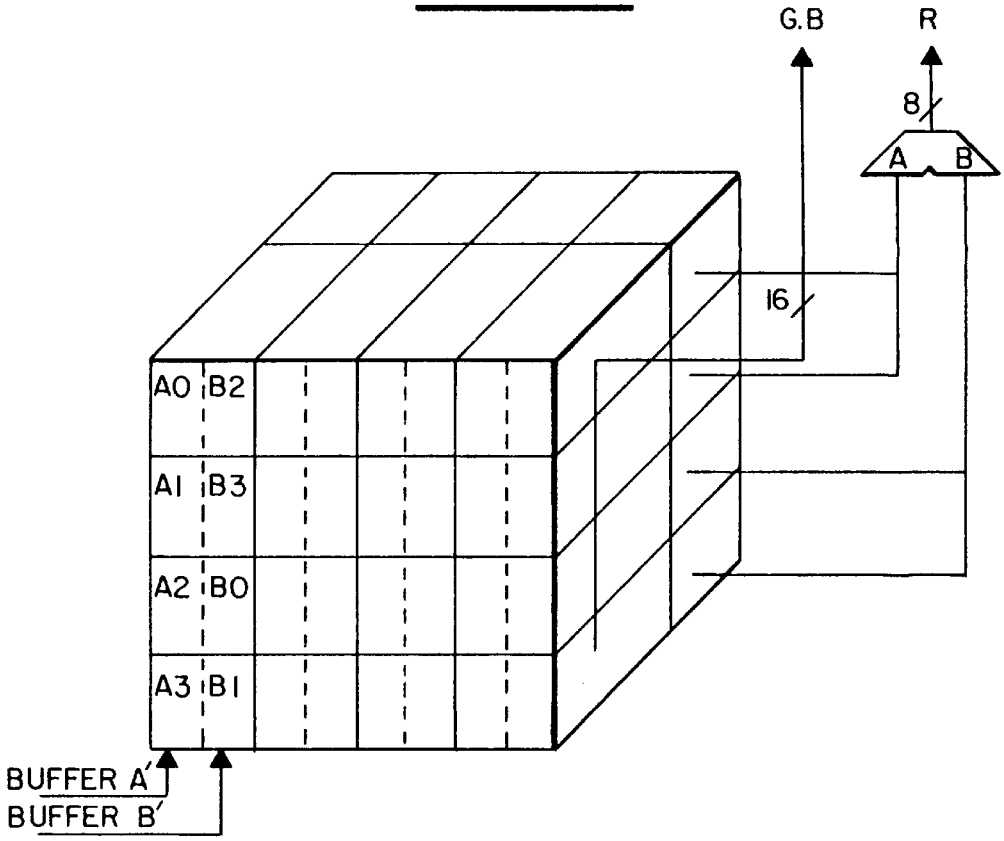
FIGS. 7*a* and 7*b* illustrate the FB with A' and B' buffers split horizontally.
Figure 7B:
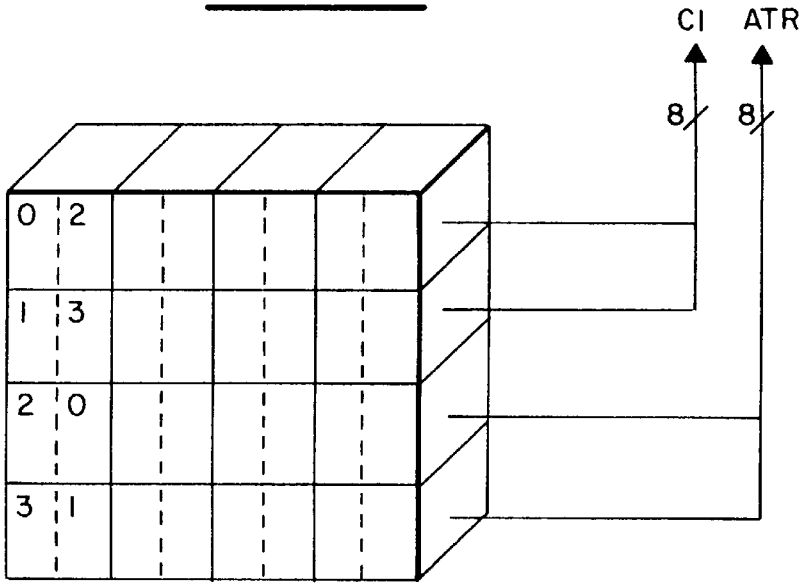

However, high resolution images require a different line placement than that just described for the medium resolution case. The SVS image is stored in dual, 2K×2K×24-bit buffers. The image buffer organization is illustrated in FIG. 7*a* and 7*b*, where the SVS line distribution (FIG. 7*a*) is similar to that of the medium resolution case, but the A' and B' buffers are split horizontally. In other words, lines in buffers A' and B' differ not by row address, but by column address. Workstation 16 lines are distributed accordingly, as seen in FIG. 7*b*.

Figure 8:
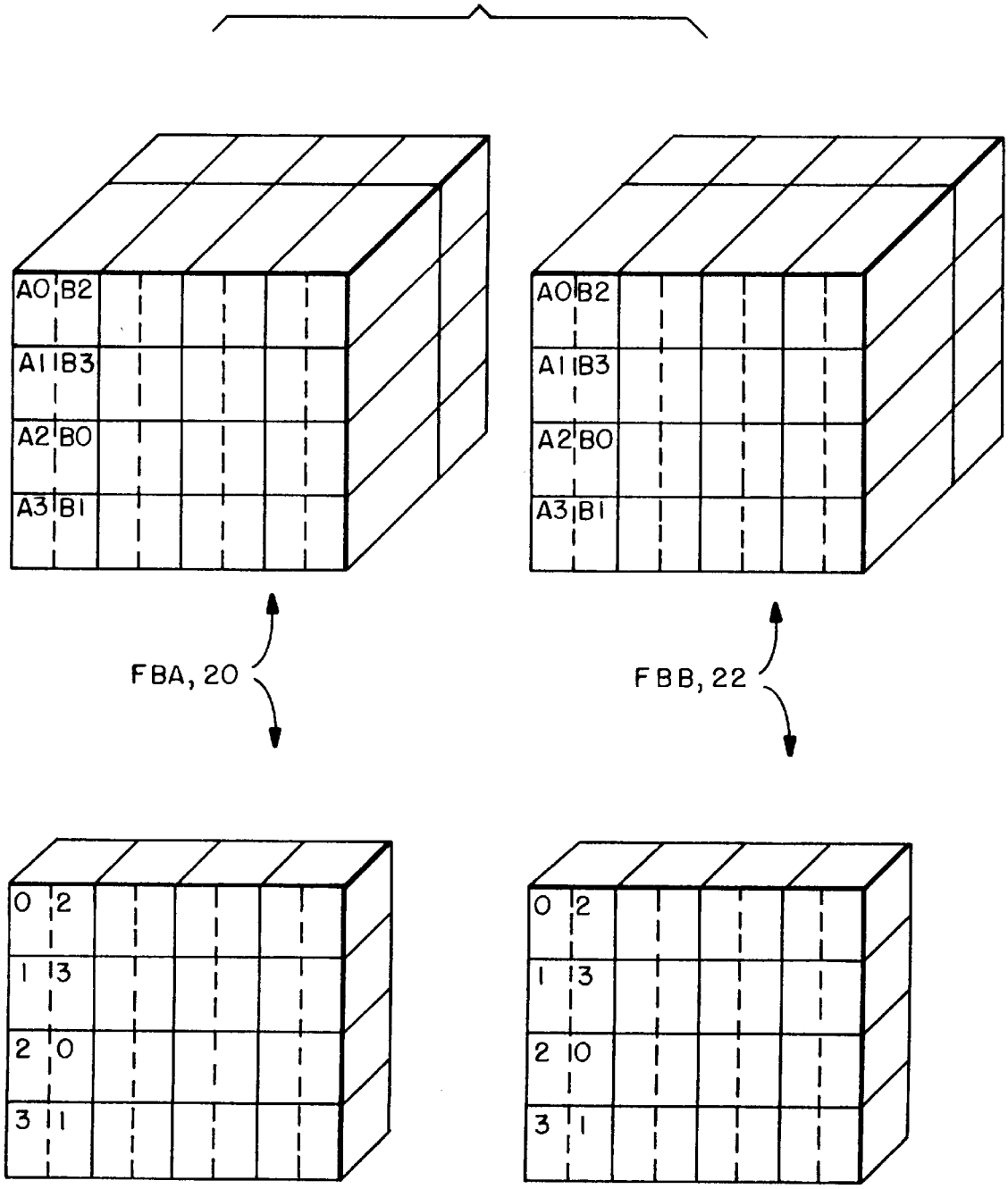
FIG. 8 illustrates the organization of a dual FB, high resolution embodiment.

FIG. 8 illustrates the organization of the dual frame buffer, high resolution case. In FIG. 8 it can be seen that the two frame buffers (FBA 20 and FBB 22) each contain elements of the dual (A', B') SVS 2K×2K×24-bit buffers, and that the WS 16 image buffer also split between the two FBs.

Figure 9:
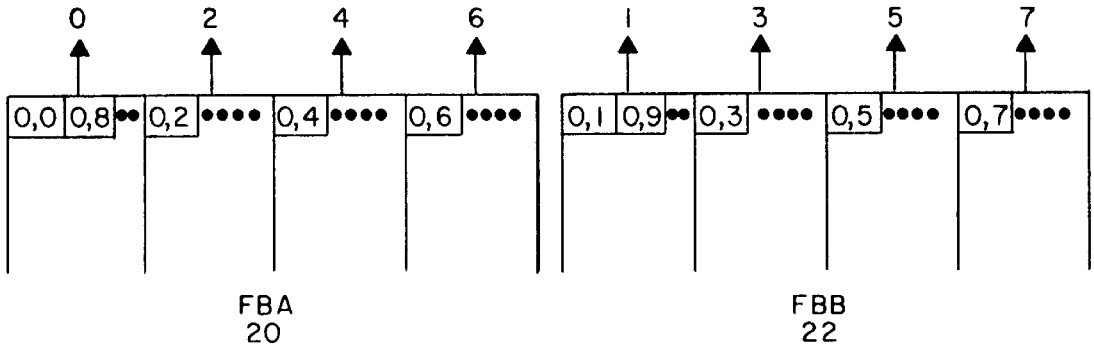
FIG. 9 illustrates, for the high resolution case, a pixel horizontal distribution where all even pixels are stored in a first FB, and all odd pixels are stored in a second FB.

For the high resolution case, the pixel horizontal distribution is illustrated in FIG. 9, where all even pixels are stored in FBA 20, and all odd pixels are in FBB 22. This organization causes the output of the Serial Data Path 34 to be more uniformly distributed at the input to the Video Data Path 36.

Figure 10A:
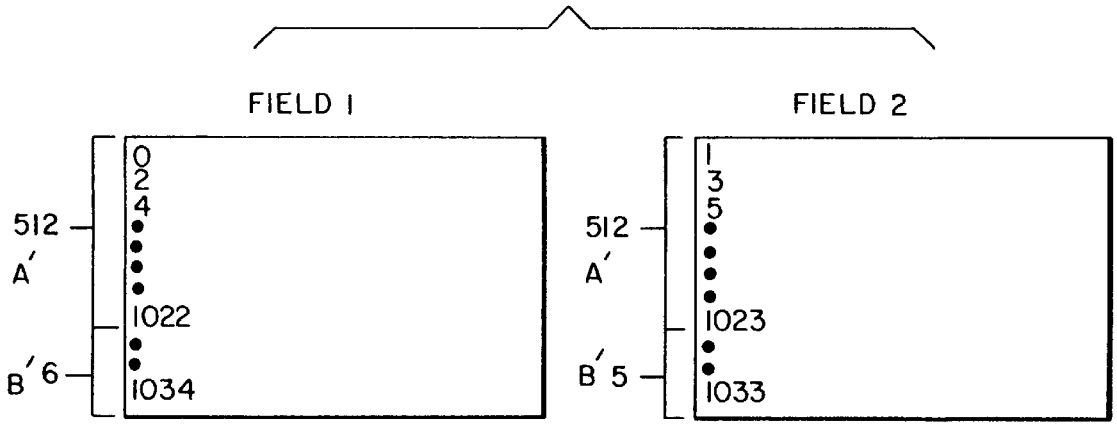
FIG. 10*a* shows two HDTV fields and the scan line numbering of each.
Figure 10B:
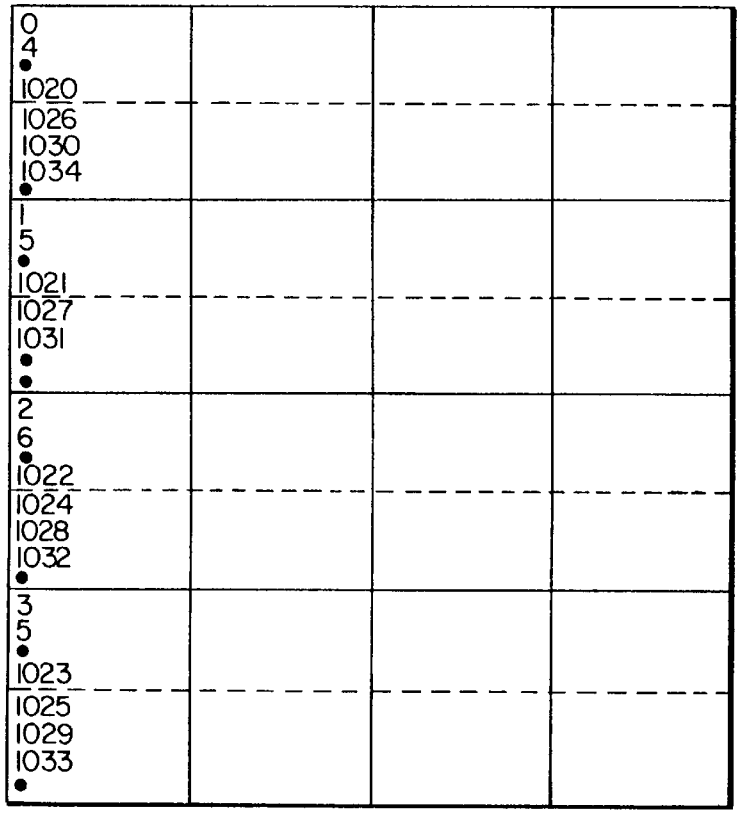
FIG. 10*b* illustrates a HDTV image line distribution.

FIG. 10*a* shows two HDTV fields with the scan line numbering of each. The HDTV image line distribution is shown in FIG. 10*b*. It resembles the medium resolution frame buffer organization described previously, but because the number of visible HDTV lines is equal to 1035, the first 1024 lines are stored in buffer A', and the remainder are stored in buffer B', in the order shown.

Figure 6C:
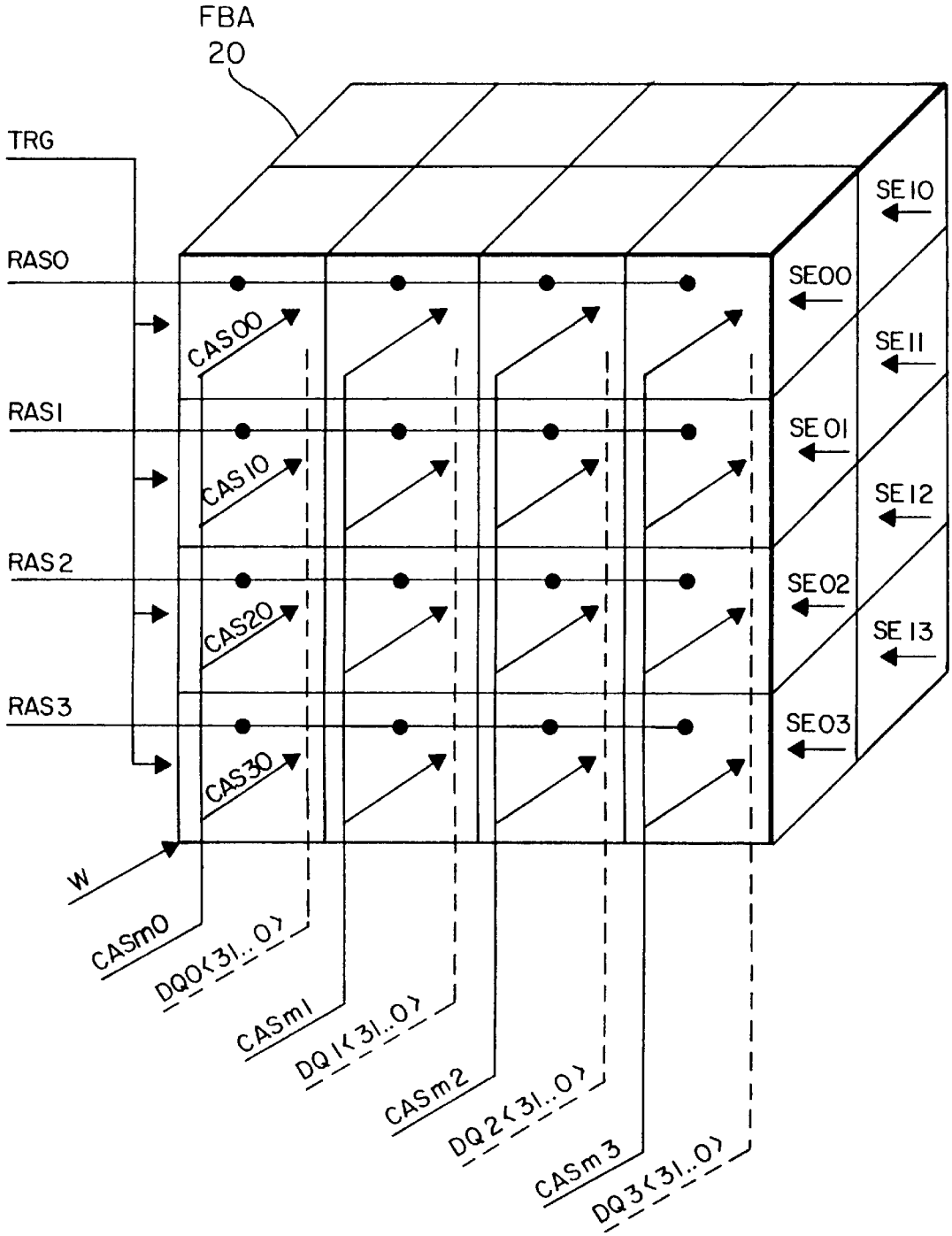
FIG. 6*c* illustrates FB control signals and primary port data.

Various FB memory cycles, including workstation read/write operations, video refresh cycles, etc., are initiated by the FBA CNTR 40 and FBB CNTR 42 devices. The FB CNTRs provide VRAM control signals, as seen in FIG. 3 and in FIG. 6*c*, and FB addresses (not shown, but common to all VRAMs). Each row of the FBs (FBx0mi, FBx1mi; FBx2mi, and FBx3mi) has a corresponding row address strobe (RAS) signal (RAS0-RAS3, respectively), while each column (FBxn0i; FBxn1i, FBxn2i, and FBXn3i) has a corresponding column address strobe (CAS) signal (CAS0–CAS3, respectively). There are four write enable (WE) signals WEWS, WER, WEG, and WEB, one for each 8-bits of the 32-bit FB, which allow writing to individual bytes. The serial enable signals (SE<0:3>) specify a line number to be video refreshed. That is, the two least significant bits of the video refresh address enable one of the SE signals. The SE <0:3> signals control only the FBxmn0 VRAMS, for only one row of these VRAMs are required for each particular line. In contrast, the FBxmn1 VRAMs store not only the red image, but also the WS image, which is stored in two memory rows. Therefore, two additional serial enable signals SE 4,5 are generated by OR gates OR1 and OR2 for the FBxmn1 VRAMS. These aspects of the invention are also described in greater detail below in relation to FIG. 12*a*.

Workstation Data Path 30,32

As seen in FIG. 3 the data path from the WS 16 to the FB enables WSDP A 30 or WSDP B 32 data to be written to or read back from the FBs. The WSDP architecture enables one 32-bit workstation word to represent different operations, depending on a user-specified MODE. For example, a workstation word may represent four, 8-bit workstation Color Index or WID values, or one 24-bit full-color pixel, or a single 8-bit color component for each of four successive pixels. This degree of flexibility is achieved by using four WSDPs, where the WS 16 data is common to all four WSPPs and where each has a separate 32-bit output to the associated FB.

Figure 11:
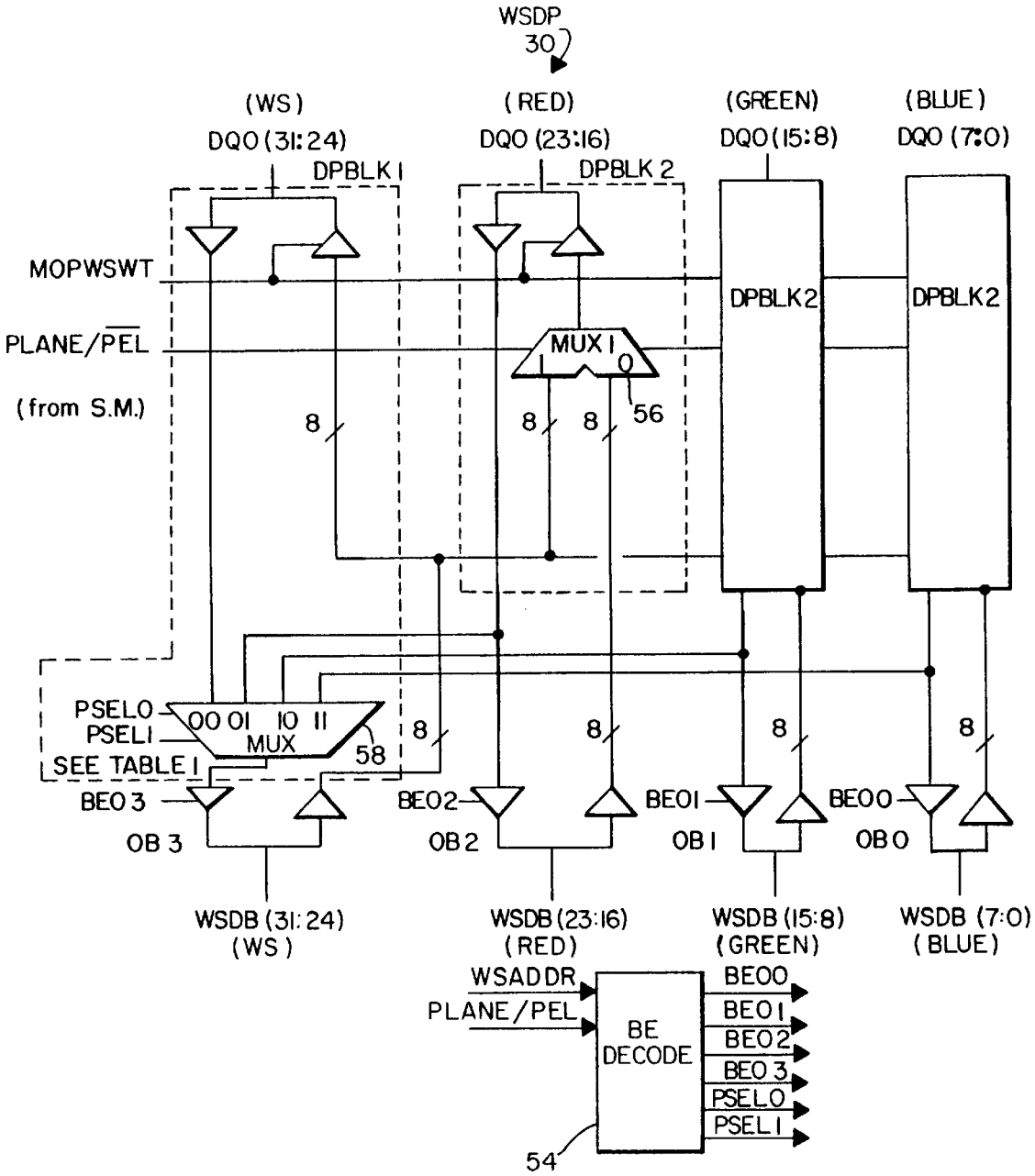
FIG. 11 is a block diagram of one of four workstation data path devices employed at an output of each FB.

A block diagram of one of the four WSDP 30 or 32 devices is shown in FIG. 11. The input WS 16 data is shown as partitioned into four bytes at the bottom, while the four FB output bytes are shown at the top. There are four subsections, of two different types, denoted DPBLK1 and DPBLK2. DPBLK1 is used in only the leftmost subsection. The subsections in the other WSDP devices are functionally identical to DPBLK1 and DPBLK2, where the DPBLK1 block moves one section to the right for each of the three other WSDP devices. For example, in WDSP 3, DPBLK1 is the right-most subsection, which connects WSDB(7:0) with DQ3(7:0), where DQ3 refers to the rightmost 32-bit FB data bus. Output buffers (OB0–OB3) are enabled through BE decoder 54 by a decode of a memory operation code (MOP) from the associated SMA 44 or SMB 46, when MOP is decoded as a Workstation Write (MOPWSWT) operation.

FB writing occurs as either color plane (PLANE mode) writes or pixel (PEL mode) writes. The mode is defined by a PLANE/PEL signal generated by the associated FBA CNTR 40 or FBB CNTR 42. For PLANE mode writes, which include four 8-bit members of a set (e.g. 4 Red, 4 Green, 4 WS Color Index, etc.), one byte of the WSDB drives all four DQ bytes on the output to the FB. In FIG. 11, WSDB (31:24) passes through DPBLK1 to drive DQ0 (31:24). It is also selected by the 2-to-1 multiplexer MUX1 56 in each DPBLK 2 block to drive the three bytes of DQ(23:0). In the WSDP(1) WSDB(23:16) drives all 32-bits of the FB data path DQ1(31:0), and so forth in WSDP(2) and WSDP(3). The Write Enable signals (WER, WEG, WEB, and WEWS), are employed to select which component of the FB is written. For example, to write four Red pixels the four red values are presented on WSDB(31:0). WSDB (31:24) drives DQ0(31:0), WSDB(23:16) drives DQ1(31:0), WSDB(15:8) drives DQ2(31:0), and WSDB(7:0) drives DQ3(31:0). The signal Write Enable Red (WER) is activated, and the Red components are driven to each of the four FB DQ buses, with the result that four 8-bit Red components are written within the FB with one 32-bit WS 16 write.

Pixel mode writes operate as follows. All four WSDPs couple the 32-bit WSDB bus directly to their respective 32-bit FB DQ data buses. One column of the FB is written by activation of that column's CAS signal. Hence, one 24-bit (or 32-bit, if appropriate) pixel value is written to the FB in a 32-bit WS 16 write.

Workstation Read cycles operate similarly, with the appropriate data steering being provided by selectively enabling the 8-bit drivers on the WS 16 side of the WSDP devices, via the Byte Enable signals (BE0:3) generated by the decoder BE DECODE 54.

For a FB data read in PLANE mode, each WSDP device is enabled to drive one of the four WSDB bytes. WSDP(0) drives WSDB(31:24), WSDP 1 drives WSDB(23:15), etc. The selection of which component (R, G, WS, etc.) to read is made by a 4-1 multiplexer (MUX) 58. The MUX 58 control signals PSEL0 and PSEL1 are generated by the BE DECODE 54 by decoding WSADDR. For example, to read the Red component, PSEL (1:0) is set to "01" and four Red pixel components on DQx(23:16) (x=0 to 3) are transferred to the WSDB.

For pixel mode reads, only one of the four WSDP devices drives WSDB, depending on the address of the pixel being read. When 32-bit pixel values are used, all 4 bytes are driven. Otherwise, for 24-bit pixel values only WSDB (23:0) are driven.

Two other functions included in the WSDP devices are a Plane Mask and a Block Write feature. The Plane Mask enables selective bits of the 24-bit RBG or 8-bit WS pixels to be protected from writes via a conventional write-per-bit function of the VRAMs. The Block Write feature enables a performance gain by exploiting another feature of the VRAMS. A static color is first loaded into the VRAMs using a "Color Write" cycle. Then, a 32-bit word from the WS 16 is reinterpreted as a bit mask, where pixels with corresponding 1's are set to the stored color, while those with 0's are not written. This feature is especially useful for text operations, where a binary font may be directly used to provide the mask. In order to use this feature, the 32-bits of WS data are rearranged via logic provided in the WSDP devices.

FBA CNTR 40 and FBB CNTR 42

Figure 12E:
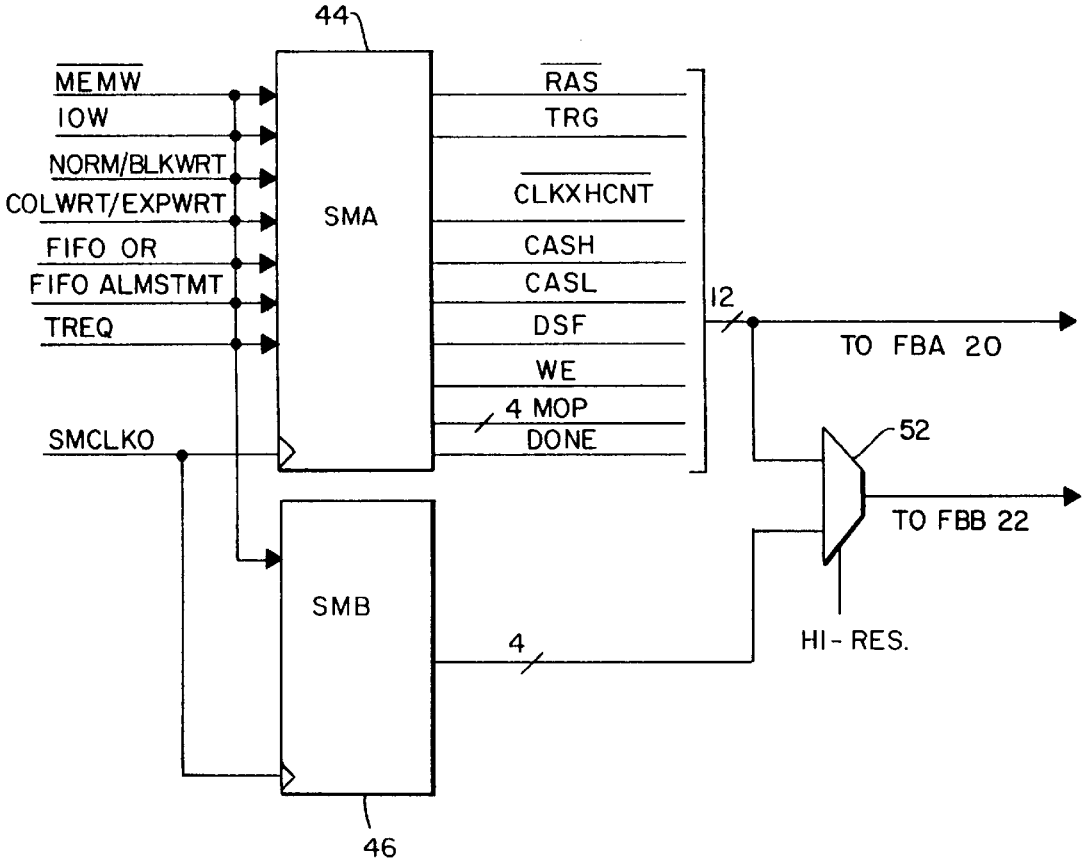
FIG. 12*e* shows two state machines and their respective inputs and outputs.
Figure 12A:
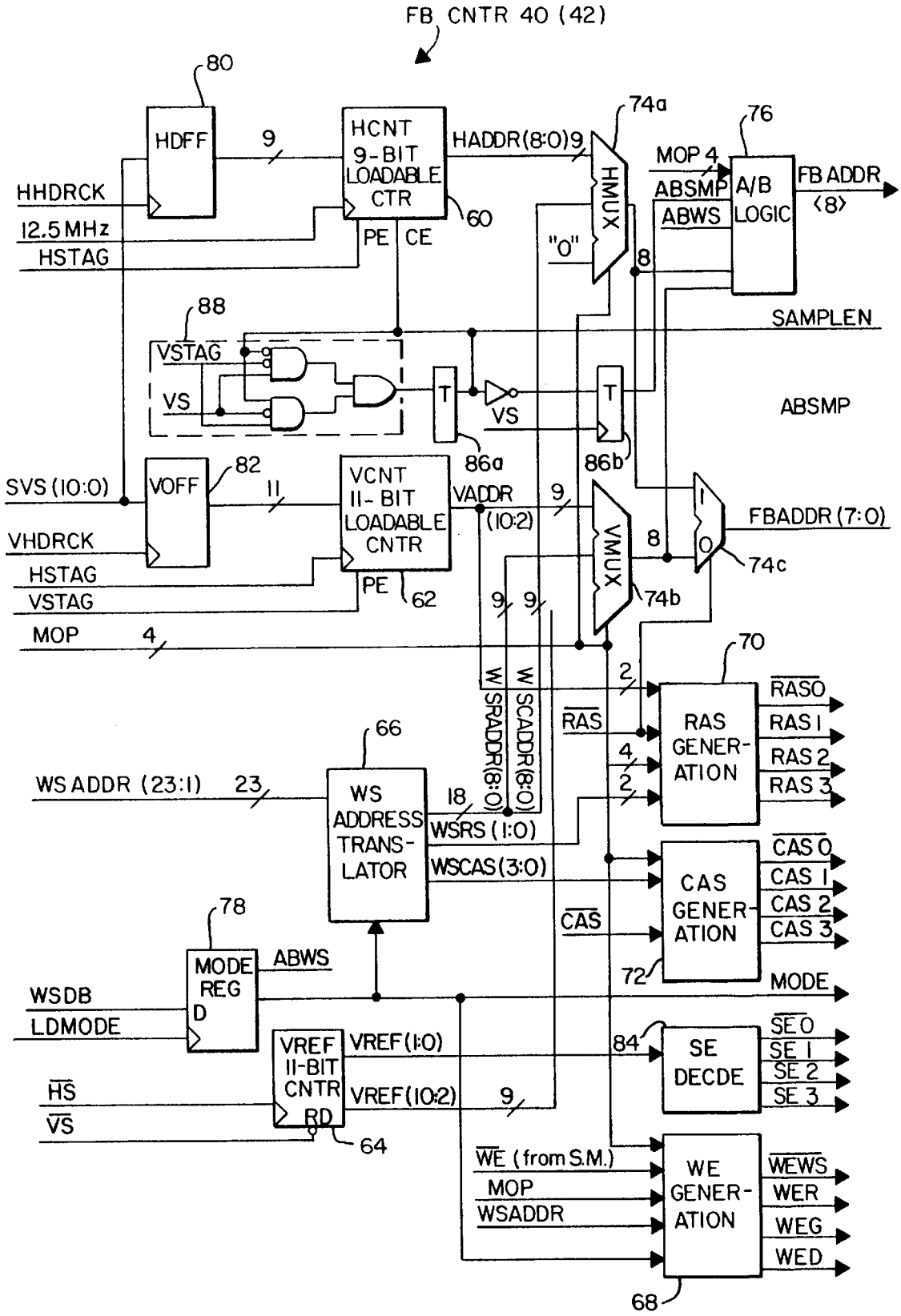
FIG. 12*a* is a block diagram of a FB controller.

FIG. 12*a* is a block diagram of one of the FB CNTRs 40 or 42. The FB CNTR provides all of the addresses and most of the control signals to the associated FB. The FB CNTR includes: counters 60 and 62 to automatically address rectangular regions of the FB as pixel data arrives from the HSI 26, HDTVI 28, or WS Interface 38; a video refresh (VREF) counter 64; a WS Address Translator 66; write-enable (WE) Generation logic 68; RAS and CAS Generation logic (70, 72), address multipliers 74*a*, 74*b*, 74*c*; and A/B Logic 76 to synchronize incoming double buffered SVS data with the monitor 18. The FB CNTR also contains a MODE register 78 that determines a type of access performed by the WS 16.

As will be made apparent below, one feature of the invention is the loading of HPPI data into the FBs. In this regard reference is made to commonly assigned U.S. patent application Ser. No. 07/734,383 filed Jul 22, 1991, entitled "Communication Apparatus and Method for Transferring Image Data from a Source to One or More Receivers", S. Choi et al.

Figure 12B:
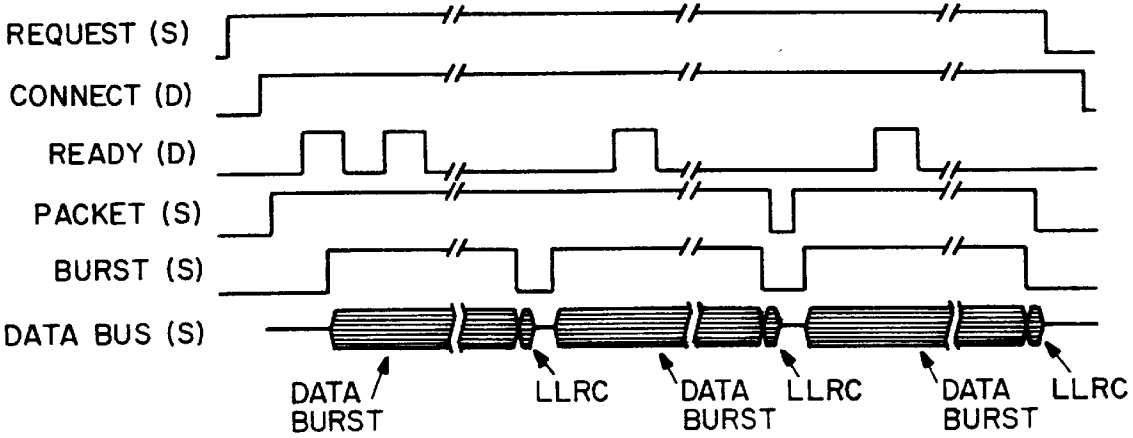
FIG. 12*b* is an illustrative timing diagram of a synchronous transfer of three data bursts from a source (S) to a destination (D) over a High Performance Parallel Interface (HPPI)

Referring to FIG. 12*b* there is shown an illustrative timing diagram of a synchronous transfer of three data bursts from a source (S) to a destination (D) in accordance with the HPPI specification entitled "High-Performance Parallel Interface Mechanical, Electrical, and Signalling Protocol Specification (HPPI-PH)" preliminary draft proposed, American National Standard for Information Systems, Nov. 1, 1989, X3T9/88-127, X3T9.3/88-032, REV 6.9, the disclosure of which is incorporated by reference herein.

Each data burst has associated therewith a length/longitudinal redundancy checkword (LLRC) that is sent from the source to the destination on a 32-bit data bus during a first clock period following a data burst. Packets of data bursts are delimited by a PACKET signal being true. The BURST signal is a delimiter marking a group of words on the HPPI data bus as a burst. The BURST signal is asserted by the source with the first word of the burst and is deasserted with the final word. Each burst may contain from one to 256 32-bit data words. A REQUEST signal is asserted by the source to notify the destination that a connection is desired. The CONNECT signal is asserted by the destination in response to a REQUEST. One or more READY indications are sent by the destination after a connection is established, that is, after CONNECT is asserted. The destination sends one ready indication for each burst that it is prepared to accept from the source. A plurality of READY indications may be sent from the destination to the source to indicate a number of bursts that the destination is ready to receive. For each READY indication received, the source has permission to send one burst. Not shown in FIG. 12*b* is a CLOCK signal defined to be a symmetrical signal having a period of 40 nanoseconds (25 MHz) which is employed to synchronously time the transmission of data words and the various control signals.

In summary, the HPPI-PH specification defines a hierarchy for data transfers, where a data transfer is composed of one or more data packets. Each packet is composed of one or more data bursts. Bursts are composed of not more than 256 32-bit data words, clocked at 25 MHz. Error detection is performed across a data word using odd parity on a byte basis. Error detection is performed longitudinally, along a bit column in the burst, using even parity, and is then appended to the end of the burst. Bursts are transmitted on the ability of a receiver to store or otherwise absorb a complete burst. The receiver notifies the transmitter of its ability to receive a burst by issuing the Ready signal. The HPPI-PH specification allows the HPPI-PH transmitter to queue up 63 Ready signals received from a receiver.

FIG. 12*c* illustrates an adaptation made by the system of the invention to the HPPI data format of FIG. 12*b* to accomplish image data transfers. A packet of data bursts corresponds to either a complete image frame, or to a rectangular subsection thereof, referred to as a window. The packet includes two or more bursts. A first burst is defined to be a Header burst and contains generic HPPI device information, the HPPI Header, and also image data information, referred to herein as an Image Header. The remainder of the Header burst is presently unused.

Following the Header burst are image data bursts containing pixel data. Pixel data is organized in raster format, that is the left-most pixel of a top display scanline is the first word of the first data burst. This ordering continues until the last pixel of the last scanline. The last burst is padded, if required, to full size. Each data word contains 8-bits of red, 8-bits of green, and 8-bits of blue (RGB) color information for a specific pixel. The remaining 8-bits of each 32-bit data word may be employed in several manners. For linearly mixing two images, the additional 8-bits may be used to convey key, or alpha, data for determining the contribution of each input image to a resulting output image. Another use of a portion of the additional 8-bits of each data word is to assign two additional bits to each color for specifying 10-bits of RGB data. Also, a number of data packing techniques may be employed wherein the additional 8-bits of each word are used to increase the effective HPPI image transfer bandwidth by one third, when using 24-bit/pixel images.

Figure 12D:
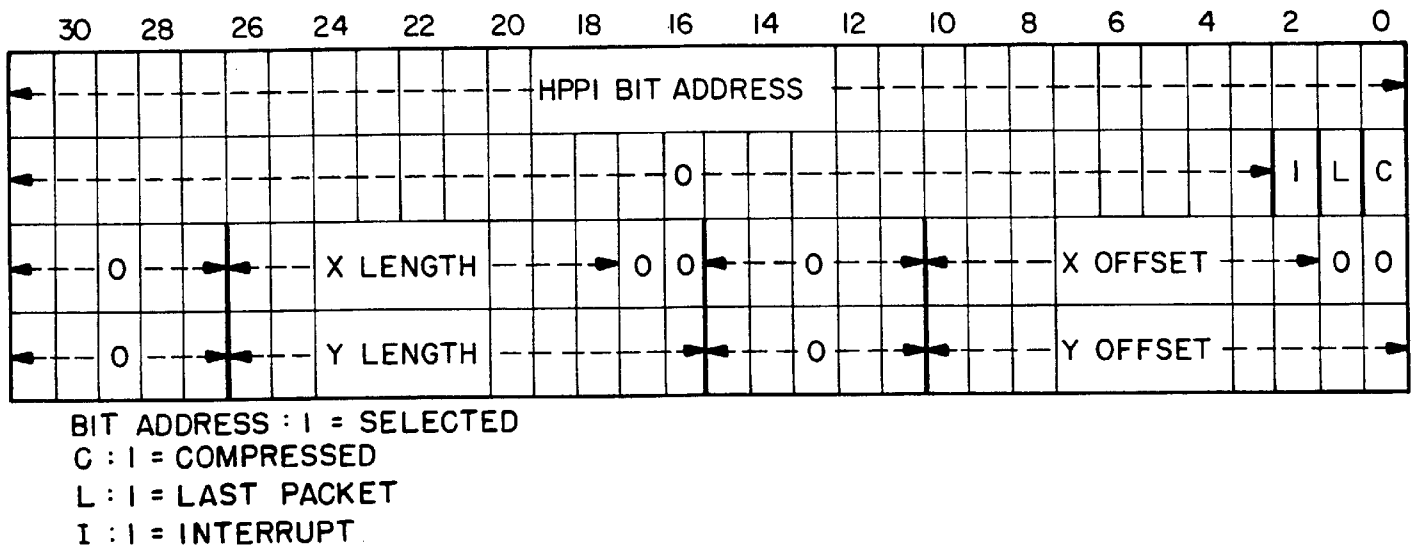
FIG. 12*d* illustrates in greater detail the organization of the Image Header of FIG. 12*c;*

FIG. 12*d* illustrates in greater detail the organization of the Image Header of FIG. 12*c*. A HPPI Bit Address, to which a specific WS 16 responds, is the first word of the Image Header. In that the data word is 32-bits wide, a maximum of 32 unique addresses may be specified. Following the HPPI Bit Address word is a control/status word used to communicate specific image/packet information to the workstation. These include a bit for indicating if the pixel data is compressed (C), a bit for indicating if the associated Packet is a last packet (L) of a given frame (EOF), and an Interrupt signal (I) which functions as an ATTENTION signal. The last two words of the Image Header (X-DATA and Y-DATA) contain size (length) and location (offset) information for the x and y image directions. By example, if the packet is conveying a full screen of pixel data, x-length and y-length may both equal 1024, for a 1024×1024 resolution screen, and the offsets are both zero. If the packet is instead conveying image data relating to a window within the display screen, x-length and y-length indicate the size of the window and the two offsets indicate the position of the upper-left most corner of the window, relative to a screen reference point.

Referring again to FIG. 12*a* the horizontal counter (HCNT) 60 provides the horizontal component of the FB address while SVS or HDTV data is being stored in the FB. HCNT 60 is loaded with a Horizontal Starting address from register HOFF 80, via a Horizontal Sync Tag (HSTAG) signal from a HPPI or HDTV Tag Bus. HSTAG drives the Parallel Enable (PE) input of HCNT 60 at the beginning of each new scanline of incoming HPPI (or HDTV) data. As the pixel data received by the HSI 26 from the HPPI channel is written to the FB, and if a Sample Enable (SAMPLEN) signal is active, the HCNT 60 is incremented by a 12.6 MHz clock signal. This clock is multiple of the HPPI clock period (40 ns), and also drives the associated SM 44 or SM 46 which controls SVS image loading into the correspondent FB. In the case of loading a HDTV image, the HCNT clock is 60 ns, which is a multiple of four HDTV sampling clocks. The 60 ns clock is also input to the associated SM 44 or SM 46 for controlling an HDTV image load to the correspondent FB.

The HOFF register 80 is set to the x-coordinate of the left edge of a rectangular display region by a value on the SVS data bus (SVS (10:0)) with a horizontal header register clock (HHDRCK) derived from a Header Tag on the Tag Bus. It should be noted that the SVS (10:0) bus is multiplexed with the WSDB bus. Thus, in the case of HDTV image loading, register HOFF is instead loaded by the WS 16, since there is no corresponding header data in the HDTV data stream.

VCNT 62 provides the vertical component of the FB address when SVS or HDTV data is stored in the FB. VCNT 63 is loaded with a vertical starting address from a VOFF register 82 at the beginning of each HPPI image data packet, as indicated by a vertical sync tag (VSTAG) signal on the SVS Tag Bus being true. At the end of each scanline of data, VCNT 62 increments via HSTAG, with VSTAG inactive. The VOFF register 82 is loaded from the SVS data bus SVS(10:0) at the beginning of each new HPPI packet via the VHDRCK signal, which is derived from the Header Tag signal on the Tag bus. As in the HDTV case, register VOFF 82, like HOFF 80, is loaded by the WS 16, since there is no corresponding header data in the HDTV data stream.

The Workstation Address Translator 66 translates addresses coming from the WS 16 address bus into the appropriate vertical and horizontal FB address components WSRADDR (8:0) and WSCADDR (8:0), respectively, as well as Workstation RAS Select (WSRS) and Workstation CAS (WSCAS) signals, as a function of the access mode and the display resolution.

The CAS Generation logic 72 derives four CAS Control bits CAS (3:0) which determine which of the four columns of the 4×4 FB structure are to be accessed, depending on the current memory operation (MOP) as previously described. For PLANE mode accesses, all four WSCAS signals are active, allowing four pixels in a row to be updated simultaneously. For PEL mode accesses, only one WSCAS signal is active, depending on which RGB pixel is being accessed. This enables both horizontal FB accesses (e.g. four 8-bit WS 16 pixels), and depth-wise FB accesses (e.g. one 24-bit or 32-bit RGB pixel) to occur. For all other operations, such as memory and video refresh, all four CAS0-CAS1 signals are asserted.

Before the beginning of each display scanline a Display Update cycle is performed to the VRAM array to transfer the contents of the next scanline into the VRAM's serial shift registers. The VREF Counter 64 generates the sequence of row addresses to be transferred, counting sequentially from zero for the first scanline of a frame up to the number of scanlines of the display screen. VREF counter 64 counts the horizontal sync (HS) signal. When the last scan line of the display screen is displayed, the vertical sync (VS) signal resets the VREF counter 64 to zero. Both the VS and HS signals are generated by SYNCGEN 24*a*, as described below. The two least significant bits <1:0> of VREF counter 64 are applied to a Serial Enable Decoder (SE DECODE) 84, to determine which one of four Serial Enables, (SE (3:0)) to activate, depending on which row of the FB corresponds to the current scanline.

The access Mode register 78 controls FB access from the WS 16. Mode register 78 selects between PLANE and PEL modes, and between HDTV and SVS FB accesses. The selected access mode influences the Address, CAS, and the Write Enable generation logic 68, as well as the external data path steering logic of the WSDP devices (30, 32), as previously described.

HMUX 74*a* determines the column address that is presented to the FB at the falling edge of CAS, as a function of the Memory Operation (MOP). For SVS or HDTV data write cycles, this is the output HADDR (8:0) of the HCNT Counter 60. For Display Update cycles a constant zero address is selected, in that it is conventional practice to begin serializing pixels for a new scanline starting from the leftmost pixel (at column address zero). Of course, an initial value other than zero may be supplied if desired.

VMUX 74*b* determines a row address, presented to the FB at the falling edge of RAS, as a function of the Memory Operation (MOP). For SVS or HDTV data this is the output of the Vertical Counter 62, VADDR (10:2). For WS 16 accesses, the vertical component of the address translation 66 logic output, WSRADDR (8:0), is selected. For Display Update cycles, the VREF 64 Video Refresh Address, VREF (10:2), is selected.

The Frame Buffer Address Multiplexer 74*c* provides a final 9-bit address, FBADDR (8:0), to the FB and drives the Row Address until RAS is asserted, after which the Column Address is driven.

The WE Generation logic 68 routes the write enable (WE) signal from the associated SMA 44 or SMB 46 to the appropriate portion of the FB, based on the output of the Access Mode Register 78 (MODE), the Memory Operation (MOP), and the WS 16 address. As a result, four write enable signals WER (for Write Enable Red), WEG, WEB and WEWS (for Write Enable Workstation) are generated.

The RAS Generation logic 70 routes the RAS signal from the associated SMA 44 or SMB 46 to the appropriate portion of the FB, based on the current address information and the Memory Operation (MOP) being performed. The four sections correspond to the four rows of the FB organization, each being controlled by RAS0, RAS1, RAS2, and RAS3, respectively.

Figure 13:
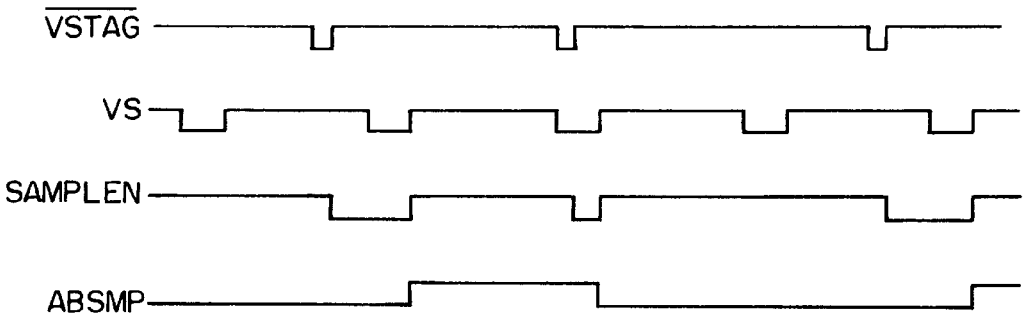
FIG. 13 is a timing diagram illustrating the operation of A/B Buffer selection logic of the FB controller.

The FB CNTRs 40 and 42 also include logic to synchronize incoming SVS data with the monitor 18 so that the display buffer currently being written to is not also the display buffer currently being output to the monitor 18*b*. This double-buffering technique eliminates motion artifacts, such as 'tearing', that would otherwise occur. This circuit, comprised of two Toggle (T) flip-flops 86*a*, 86*b* and combinatorial logic 88, disables sampling (via SAMPLEN going inactive) once a complete SVS frame is received, as indicated by VSTAG, until the next VS interval of the monitor 18 occurs. This operation is illustrated in the timing diagram in FIG. 13. When VS occurs it indicates a time to switch from one buffer to the other to begin displaying information, the other buffer presumably having just been filled with the most recent frame of SVS data via the HPPI interface. The signal ABSMP determines which buffer to write while the other buffer is video refreshed. Buffer sampling resumes, via SAMPLEN going active, when VS occurs.

The determination as to which buffer is written is performed by selectively inverting the eighth bit of the buffer address, via the A/B Logic 76. In the high-resolution mode bit 8 of the column address determines which buffer is written, since the A' amd B' buffers are split inside the VRAMs along column address 256 (FIGS. 7*a* and 7*b*). In the medium and HDTV resolution modes row address bit 8 makes this determination, since in this case the two buffers (A' and B') are split by row address 256 (FIGS. 5*a* and 5*b*).

The WS 16 also has control, during WS image loads, of which buffer to update and which to display, by toggling the ABWS signal.

SMA 44 and SMB 46

As was previously noted, there are two state machines in the HDMD 10. FIG. 12*e* shows the two state machines and their respective inputs and outputs. SMA 44 controls FBA 20 through FBA CNTR 40 and SMB 46 controls FBB 22 through FBB CNTR 42. These state machines arbitrate from among several requests for access to the FBs and perform the requested memory cycle, generating all required control signals. The requests fall into three basic categories: (a) Display Update/Refresh, (b) Sampling, and (c) Workstation. Other inputs provide information regarding the specific cycle requested, such as Read/Write, Block Write, Color Write, etc. A Display Update request has the highest priority, so that both state machines service this request before the start of the active scanline, regardless of what cycles they were each performing at the time.

When FBA 20 and FBB 22 contain different data, for example, FBA 20 contains SVS data while FBB 22 contains HDTV data, SMA 44 and SMB 46 function independently, such that one samples the SVS data while the other samples the HDTV data.

When both FBA 20 and FBB 22 contain the same data, i.e. in high-resolution mode, SMA 44 controls both FBA 20 and FBB 22, via multiplexer 52 on each of the output control lines, thus implementing a unified frame buffer control mechanism.

Once a request is allowed, the requested sequence begins, and the 4-bit Memory Operation code (MOP) is generated to notify the HDMD 10 of the type of cycle currently being executed. Other outputs include the memory control signals (RAS, WE, CAS, etc.) and a timing signal to synchronize memory operations.

A DONE signal is also generated, which goes true to signify completion of the current cycle. This signal is used to generate a reply to the WS 16, so that the cycle may be completed. Once a cycle is complete, any pending requests are serviced by the SMs, in priority order.

The following cycles are performed by the SMs, listed in order of priority:

1. Display Update/Refresh,
2. Workstation Read cycle,
3. Workstation Write Cycle,
4. Workstation Block Write Cycle,
5. Workstation Color Write Cycle, and
6. Image Sample Cycle.

It should be noted that all four workstation cycles actually have the same priority, in that there can only be one WS 16 request at a time. Most of the cycles are linear address sequences, with variations on the timing of the edges and selection of write enable, depending on whether the particular cycle is a read cycle or a write cycle. The Sample Cycles function differently, in that they operate the frame buffers in a page mode type of access. A test is performed to terminate the page mode cycle in the event that a higher priority request is pending or if the source data is near completion (HDTV or HSI FIFO almost empty).

Serial Data Path 34

Figure 14:
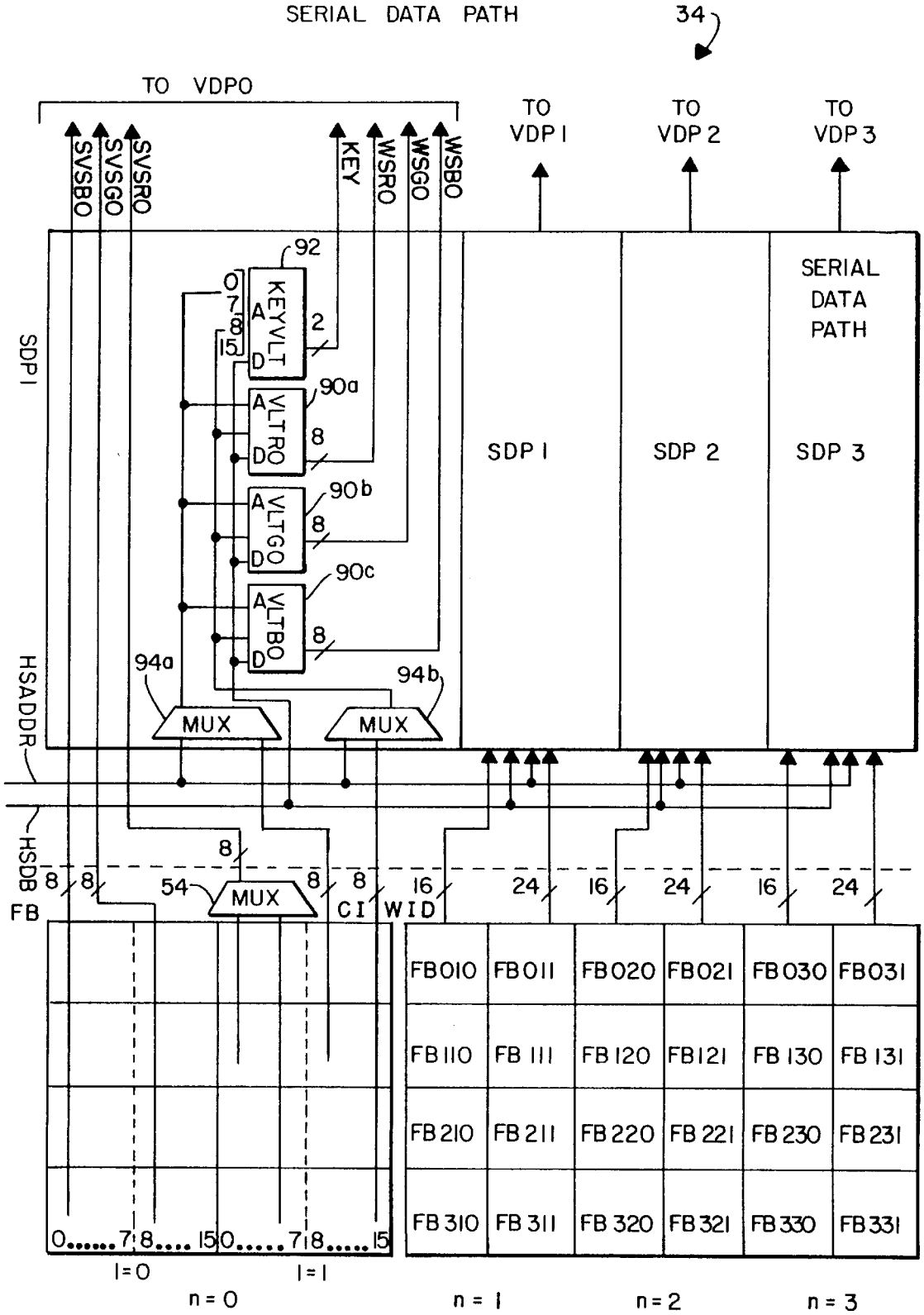
FIG. 14 illustrates eight serial data paths, four of which serve FBA and four which provide a serial data path for the FBB.

The Serial Data Path 34 provides a connection between the serial data output of the FBs and the Video Data Path 36 by means of four, 9-bit data buses. As seen in FIG. 14 there are eight serial data paths, four of which that serve FBA 20 and four of which that serve the FBB 22. FB R, G, B, values are sent directly from video data path 36 devices (VDP0, VDP1, VDP2 and VDP3). The WS 16 8-bit color index (CI) data and 8-bit window identification (WID) number are coupled to three, 64K by 8-bit RAMs (VLTR 90*a*, VLTG 90*b* and VLTB 90*c*) and to one 64K by 2-bit RAM (KEYVLT 92) per FB column, resulting in 16 VLTs for one FB. These RAMs function as video lookup tables (VLTs) to provide a full 256 by 24-bit color translation of CI data for each of the 256 WID numbers. As a result, each FB 40-bit serial data path is translated to a 50-bit data bus, providing FB 24-bit color data, WS 24-bit color data, and a 2-bit key control data (KEY) for determining image overlays. The function of the KEY value is described below in relation to the Video Data Path 36. The VLTs 90 and 92 are loaded from the WS 16 through workstation data (WSDB) and address (WSADDR) buses, using two multiplexers 94*a* and 94*b* in each serial data path.

A FB memory board is also illustrated in FIG. 14 to show the connections between the VRAMs and the Serial Data Path 34. There are eight 2 to 1 multiplexers 54 for each column of the FB, the output of which provides the Red portion of the pixel data. The use of multiplexers 54 was explained above in regard in FIG. 5*a*.

Video Data Path 36

Figure 15:
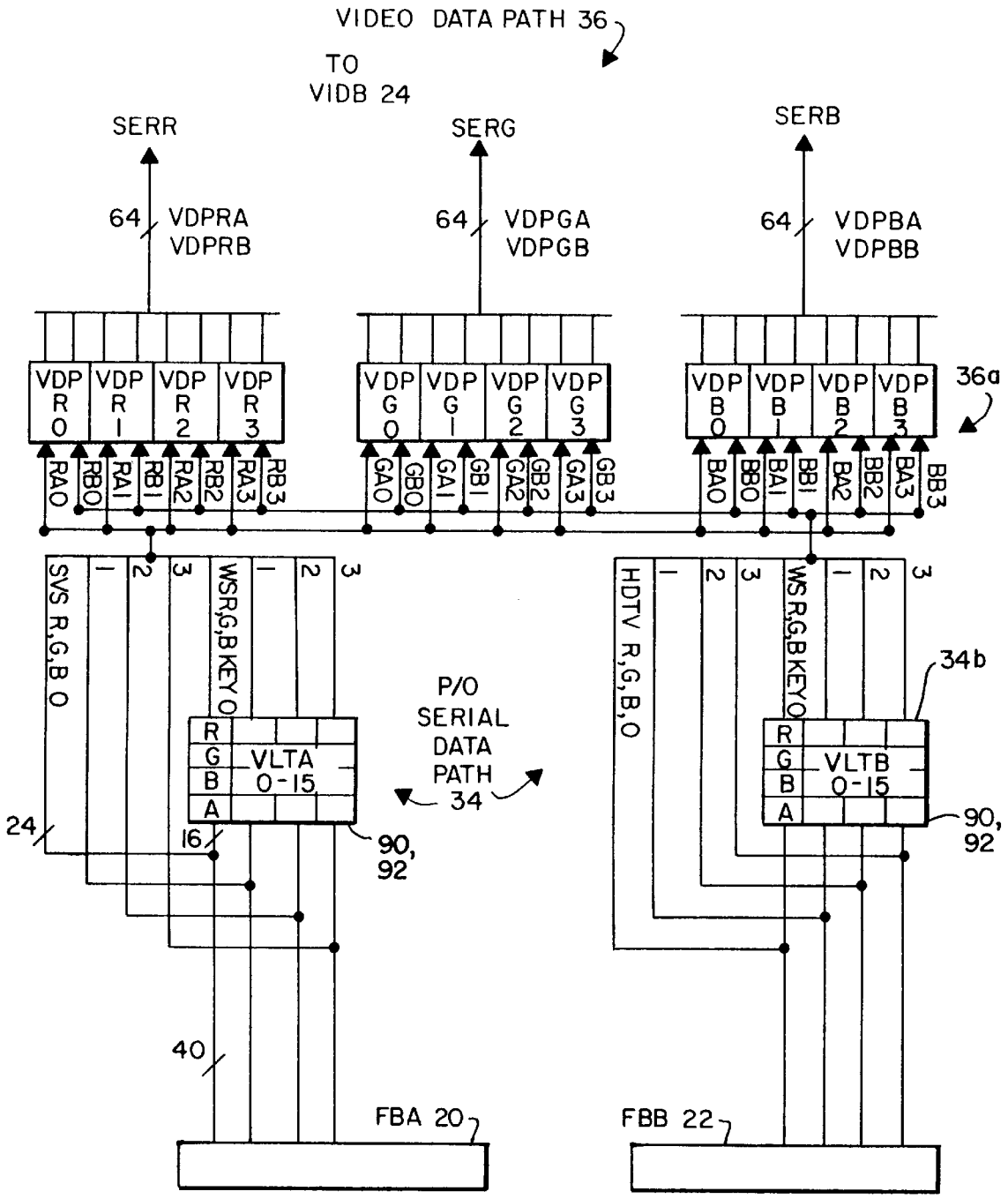
FIG. 15 illustrates a video data path 36.

As seen in FIG. 15 the Video Data Path includes three separate color video data paths comprised of 12 Video Data Path (VDP) devices 36*a*, organized as VDPR (0–3), VDPG (0–3), and VDPB (0–3). The Video Data Path 36 couples outputs of the Serial Data Path 34 to the VIDB 24 serializers 24*b*.

Each color video data path includes four VDP devices 36*a* that receive two Serial Data Path outputs. As was previously explained, each SDP 34 provides two sets of 24-bit outputs. One set represents the SVS image, in the case of FBA 20, or the HDTV image in the case of FBB 22. The other set of 24-bit outputs represents the corresponding 24-bit WS 16 pixel after lookup in the corresponding VLTs 90,92 that form a part of (P/O) the Serial Data Path 34. Each set of outputs also provides the 2-bit Key, having a value that is a function of WID and the Color Index. The two 24-bit values are regrouped by color so that, for example, SVS R0 and HDTV R0 (red) components are combined to form the 16-bit bus RA0 for FBA 20 column 0. FBA 20 is assumed to always contain the SVS image, the full image in the low resolution case, and the even pixels in the high resolution case. A similar 16-bit bus RBO is formed for FBB 22, which may store HDTV images in a medium resolution system with two FBs, or odd pixels of an SVS image in a high resolution application. It should be noted that both FBs may also hold HDTV images in a high resolution application.

Figure 16:
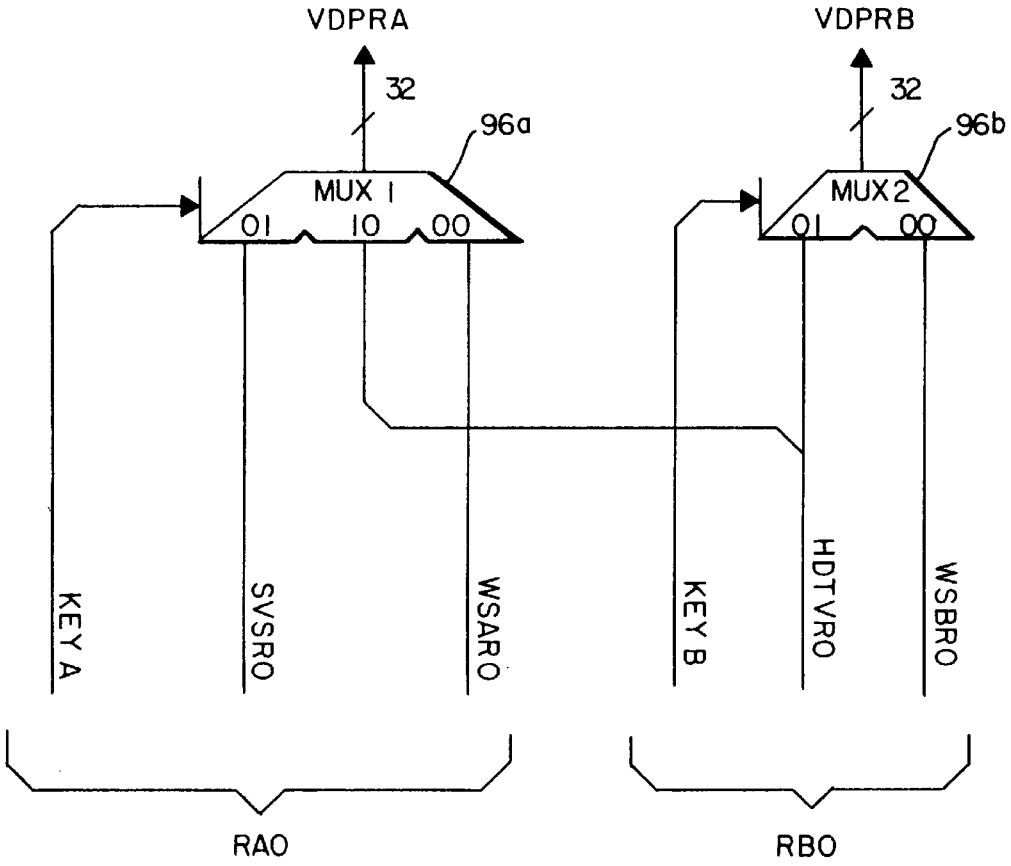
FIG. 16 illustrates the VDPR device employing eight groups of two multiplexers.

Each VDP device 36*a* receives 16-bit RA data and 16-bit RB data, along with their respective 2-bit KEY numbers, and provides multiplexing of svs, HDTV or WS images depending on the WID number and Color Index. For example, and referring to FIG. 16, the VDPR device employs eight groups of two multiplexers MUX1 96*a* and MUX2 96*b*, or one pair for each color bit. MUX1 96*a* is used in medium resolution mode, and allows the SVS, HDTV, or WS Red color to be passed to the output VDPRA, when KEYA is equal to 01, 10, or 00, respectively. In high resolution mode, the HDTV (KEY=10) path is unused. MUX2 96*b* is used only in high resolution mode and enables the HDTV (FBB 22 data) or WS 16 Red color to be passed to the VDPRB output, when KEY is equal to 01 or 00, respectively. In this case, MUX1 96*a* functions in the same manner with FBA 20 data.

Table 1 illustrates one of several examples of the switching mechanism operation.

TABLE 1

| | KEYVLT IN | | | VOP output | | |
|---|---|---|---|---|---|---|
| Mode | 15-8 WID | 7 . . 0 CI | KEY | MUX1 | MUX2 | Action |
| Med | 0 | 0-255 | 00 | WS | | WS unconditional |
| Res | 1 | 0-255 | 01 | SVS | | SVS unconditional |
| | 2 | 0-255 | 10 | HDTV | | HDTV unconditional |
| | 3 | 0 | 00 | WS | | CI = 1 |
| | | 1 | 01 | SVS | | color keying |
| | | 3-255 | 00 | WS | | between SVS and WS |
| | 4 | 0-3 | 00 | WS | | CI = 4 |
| | | 4 | 10 | HDTV | | color keying |
| | | 5-255 | 00 | WS | | between HDTV and WS |
| | 5-255 | 0-5 | 00 | WS | | CI = 6,7 |
| | | 6 | 01 | SVS | | color keying |
| | | 7 | 10 | HDTV | | between WS |
| | | 7-255 | 00 | WS | | SVS and HDTV |
| Hi | 0 | 0-255 | 00 | WS | WS | unconditional |
| Res | 1-255 | 0 | 00 | WS | WS | CI = 1 |
| | | 1 | 01 | SVS | SVS | color keying |
| | | 1-255 | 00 | WS | WS | between WS and SVS image in HiRes mode |

For each of the 256 WID numbers the KEY output of KEYVLT 92 (FIG. 14) may be loaded differently for each of the CI values. As can be seen, for a particular data load shown in Table 1, for all pixels with WID=0, only WS colors are output from the VDP 36. As a result, the WS color is unconditionally shown on the monitor 18 for all these pixels. For pixels with WID=1, the SVS image is shown unconditionally, and for pixels with WID=2, only the HDTV image is shown. For pixels with WID=3, all WS pixels with color index CI=1 are transparent, thus displaying the SVS image and providing color keying with colors corresponding to CI=1. For WID=4, CI=4 and provides color keying between WS and HDTV images. For WID=5, CI=6 and displays SVS video. CI=7 displays HDTV video. All other WS colors are not transparent.

This switching mechanism provides flexible control over different application windows, and may be used to achieve various special effects through pixel mixing. For example, arbitrarily shaped areas of the SVS image may overlay arbitrarily shaped areas of the HDTV image, while WS 16 graphics is shown on top of both images. Furthermore, and in accordance with an object of the invention, the image data is modified as desired in the video output path between the PBs and the monitor 18.

VIDB 24

Figure 17:
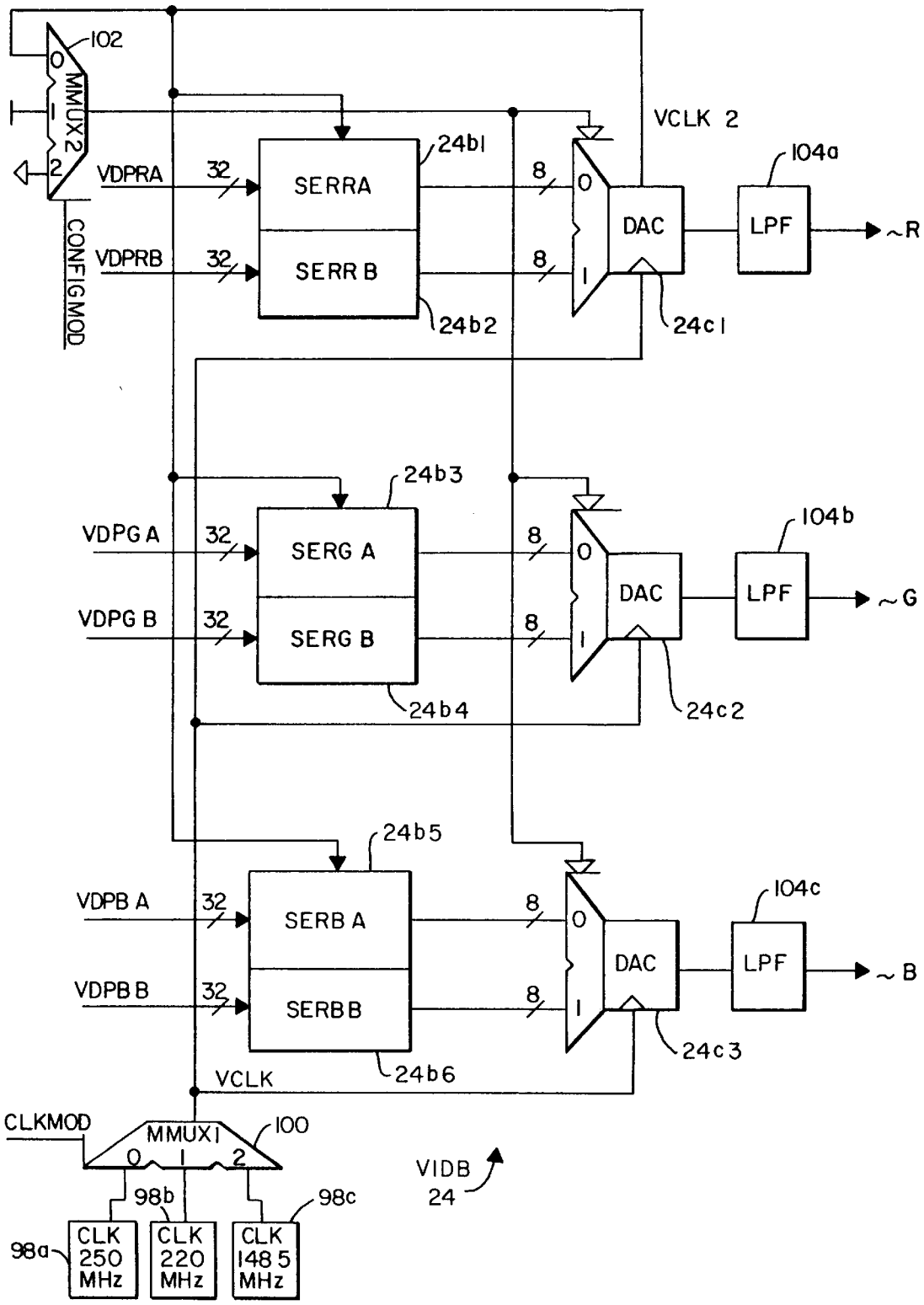
FIG. 17 illustrates the VIDB 24 includes three DAC's (24*cl*, 24*c*3, 24*c*3) each having a 2:1 multiplexer at the inputs.

As seen in FIG. 17 the VIDB 24 includes three DAC's (24*c*1, 24*c*3, 24*c*3) each having a 2:1 multiplexer at the input. There are also three clock generators 98*a*–98*c* that feed a 3 to 1 multiplexer (MMUX1) 100. One clock generator 98*a* provides a 250 MHz signal for use with a high resolution display, a second clock generator 98 provides a 220 MHz signal for use with a medium resolution display, and the third clock generator provides a 148.5 MHz signal for use with a HDTV display. The VIDB 24 also includes a MMUX2 102, and six serializers (24*b*1–24*b*6).

For each color, the 32-bit four pixel outputs VDPA and the 32-bit four pixel outputs VDPB of the Video Data Path 36 are coupled to the corresponding serializer SERA and SERB. SERA and SERB serialize, at one half of the video clock frequency, the parallel outputs A and B, respectively, of the VDP devices 36*a*. Each serializer 24*b* includes four, 8-bit shift registers. The output of each pair of serializers is connected to a corresponding DAC 24*c*.

Referring also to FIG. 9, SERA provides sequential output of pixels 0, 1, 2, 3 in the case of a medium resolution output or a HDTV resolution output. When SERB is used for storing a HDTV image, SERB provides sequential output of pixels 0, 1, 2, 3 for a medium resolution or a HDTV resolution output. In the case of a high resolution output, when SERA and SERB are used for storing a single source image (e.g. supercomputer image or HDTV image) the SERA provides sequential output of even pixels 0, 2, 4, 6, 8, etc., and SERB provides the sequential output of odd pixels 1, 3, 5, 7, 9, etc.

In accordance with another object of the invention, depending on the desired display resolution, one of the three available clocks feeds the DAC's 24*c* video clock inputs, controlled by MMUX1 100. A WS 16 programmed mode signal (CLKMOD) determines which one of the three clock generator 98 outputs is passed to the MMUX1 100 output.

Each DAC 24*c* includes a divide by two counter and a multiplexer. VCLK is divided by two in DAC 24*c*1 and is used as a clock for the serializers 24*b*1–24*b*6. The mode multiplexer MMUX2 102 controls whether VCLK/2, a logical 0, or a logical 1 feeds the DAC 24 internal multiplexer control. Depending on the state of another programmable mode signal CONFIGMOD, only the SERA outputs are converted to analog output, or only the SERB outputs are converted.

For a high resolution display, or a stereoscopic image display, the CONFIGMOD signal is set such that VCLK/2 is passed through MMUX2 102. The DAC 24 internal multiplexer thus switches DAC inputs between the outputs of SERA and SERB on each VCLK. That is, this mode is equivalent to reading eight pixels in parallel and serializing the pixels with VCLK.

For a medium resolution display with a single FB, the DACs 24 select outputs SERA or SERB, depending whether FBA 20 or FBB 22 is used. In the case of SVS image only, or in the case of HDTV image only, FBA 20 or FBB 22, respectively, is selected. This should not be confused with the output resolution, which may be medium resolution or HDTV resolution, depending on CLKMOD value. In that the serializers 24*b* are always clocked at VCLK/2, the DACs 24*c* receive new data at half speed, i.e. 125 MHz, 110 MHz, or 74.25 MHz.

The DAC 24*c* outputs are applied to low pass filters (LPF) 104*a*, 104*b*, and 104*c*. These filters provide a high quality analog video signal.

The CONFIGMOD and CLKMOD control signals are written by the WS 16 into a mode control register (not shown). As a result, the same hardware configuration is software reconfigurable to serve various image sources and output resolutions.

Synchronization Generator 24*a*

Figure 19:
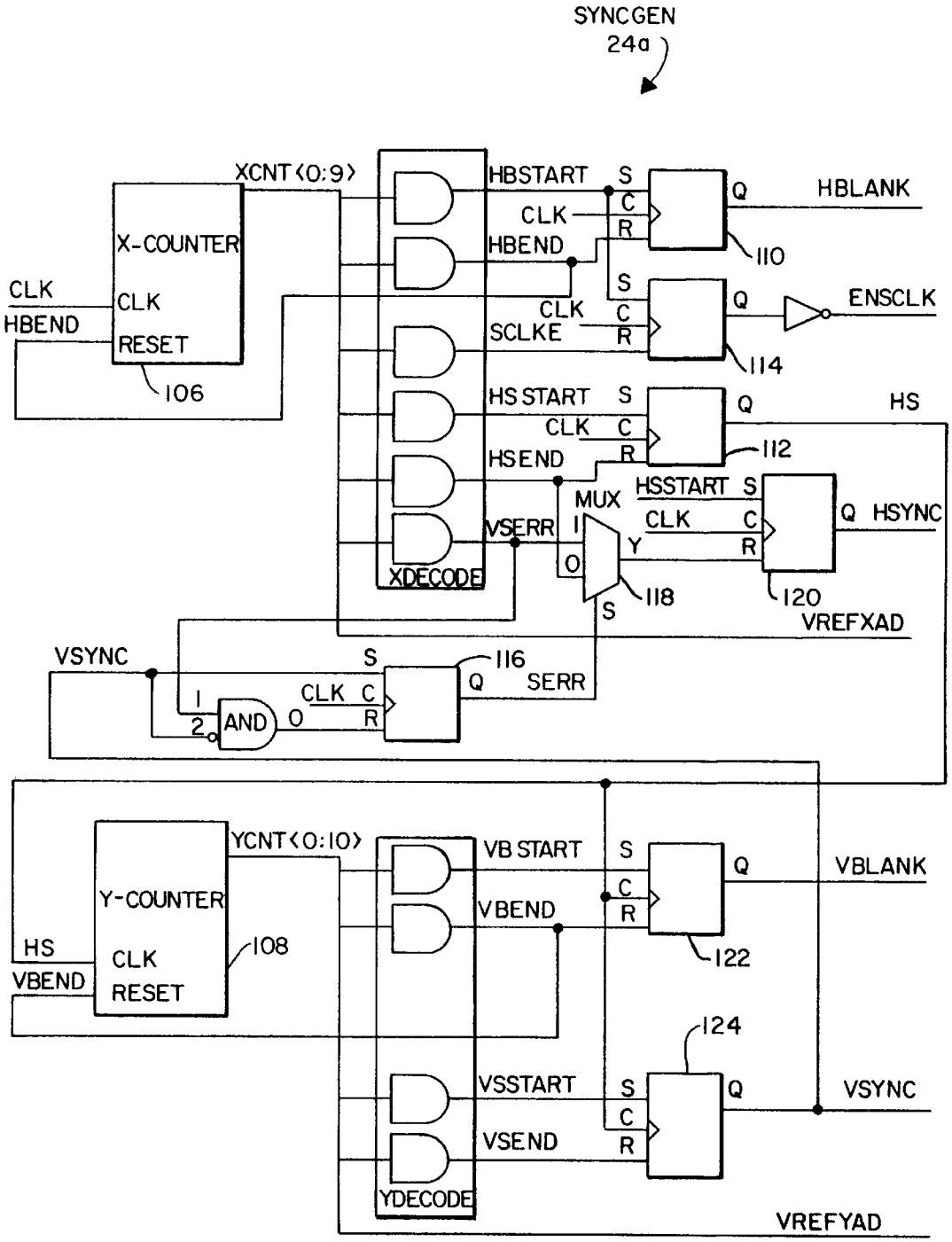
FIG. 19 illustrates two counters of a timing synchronization generator, one for an x-axis direction and one for a y-axis direction.

FIG. 19 illustrates the SYNCGEN 24*a*. The SYNCGEN 24*a* is programmed by the WS 16, depending on the required display resolution.

SYNCGEN 24*a* is initialized to one of four modes, corresponding to medium-resolution, high-resolution, HDTV, and stereoscopic. In that these modes operate similarly, the medium-resolution case is discussed below.

Figure 18:
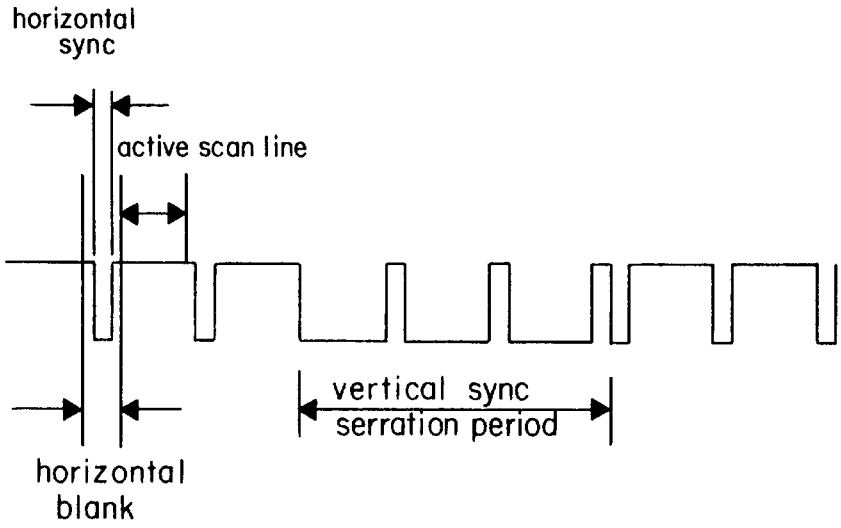
FIG. 18 is a timing diagram that depicts medium resolution horizontal and vertical synchronization pulses.

The medium-resolution sync signal shown in FIG. 18 has horizontal sync (HS) and blank periods, and vertical sync (VS) and blank periods. During VS the HS pulses are inverted. As seen in FIG. 19, to generate these signals there are two counters, one for the horizontal display direction (x-counter 106) and one for the vertical display direction (y-counter 108), plus appropriate decoding logic. The clock input to the x-counter 106 is a fraction of the horizontal pixel clock (for medium-resolution, ¼ the pixel clock frequency). The x-counter 106 generates a 10-bit signal, XCNT <0:9>, which is decoded to yield the signals HBSTART (horizontal blank start), HBEND (horizontal blank end), SCLKE (serial clock enable end), HSSTART (horizontal sync start), HSEND (horizontal sync end), and VSERR (vertical serration).

HBSTART and HBEND set and reset a flip-flop 110 to generate HBLANK (horizontal blank). Similarly, HSSTART and HSEND set and reset a flip-flop 112 to generate the signal HS. At the end of each horizontal scan line, HBEND resets the x-counter 106 to zero.

HBSTART and SCLKE set and reset a flip-flop 114 to generate a signal ENSCLK. The rising edge of the serial clock enable, ENSCLK, determines when the FB outputs the first pixel of each horizontal line. Because there is a pipeline delay between the VIDB 24 and the FB; ENSCLK falls earlier than HBLANK. Therefore, SCLKE is decoded slightly before HBEND.

Additional logic generates the serration pulses. When VSYNC is asserted it sets a signal SERR through flip-flop 116, which is applied to MUX 118 to select VSERR instead of HSEND. The decode for VSERR occurs earlier than HSSTART, thus modifying the operation of flip-flop 120 and the pattern of HSYNC (horizontal sync). This yields the three serration pulses that are shown in FIG. 18.

HS clocks y-counter 108 and the associated decoding logic. The y-counter 108 produces an 11-bit signal, YCNT <0:10>, which is decoded into signals VBSTART (vertical blank start), VBEND (vertical blank end), VSSTART (vertical sync start), and VSEND (vertical sync end). These signals are combined by flip-flop 122 to form the signal VBLANK (vertical blank), and by flip-flop 124 to form the signal VSYNC (vertical sync). At the end of each frame (that is, at the end of the vertical blank), VBEND resets the y-counter 108 to zero.

Finally, XCNT and YCNT are output as signals Video Refresh x-address (VREFXAD) and Video Refresh y-address (VREFYAD), respectively.

HSI 26

The HSI 26 provides the following functions: buffering and reformatting of high speed data from the SVS 12 to the HDMD 10 monitor 18, and buffering and reformatting of a full color HDTV image, in real time, for transfer to an external video processor or storage device, such as the SVS 12.

Figure 20:
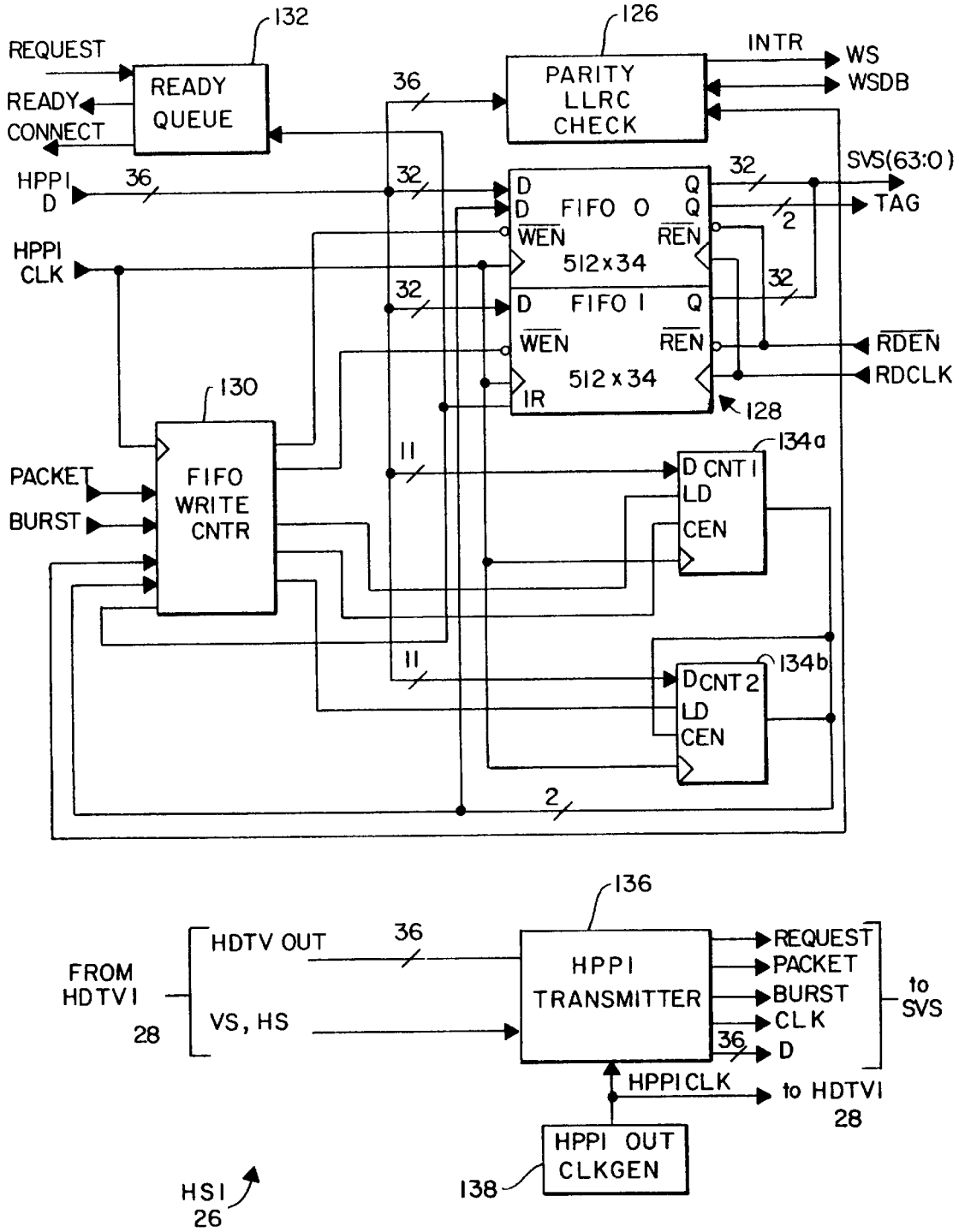
FIG. 20 illustrates the inputs, outputs, and the functional blocks of a high speed interface.

Images rendered by the SVS 12 are transmitted over the High Performance Parallel Interface (HPPI) to the HSI 26. The HSI 26 includes memory and circuitry to buffer and reformat this data for transfer to the HDMD 10. FIG. 20 illustrates the inputs and outputs and the functional blocks of the HSI 26 HPPI channel. Components of the SVS 12 to HDMD 10 data path are a Parity/LLRC Check 126 and a first in/first out (FIFO) memory 128, with an associated FIFO write control 130.

Incoming HPPI data is initially tested for bytewise and longitudinal parity errors by the Parity/LLRC Checker 126. Errors are reported to the WS 16 by an interrupt signal, INTR, and may be further clarified by means of a bidirectional status/control port, connected to the WSDB for providing the WS 16 read/write access thereto.

In parallel with Parity/LLRC error detection, image data is formatted and written to the FIFO 128 by the FIFO Write Control block 130.

A present implementation provides sufficient FIFO 128 memory capacity to store four data bursts (1024 words), hence four HPPI READY signals are issued by the FIFO Write CNTR 130, via Ready Queue 132, at the beginning of a packet transfer. These four READY signals are buffered by the SVS 12 HPPI transmitter. During the image data transfer the SVS 12 HPPI transmitter has, typically, three READY's queued, in that the FIFO 128 read rate by the HDMD 10 FB is nominally greater than the write rate from the HPPI. However, this is not always the case. By example, the local host WS 16, which has a higher priority, may be extensively accessing the FB. The FIFO 128 is thus read at a slower rate, and READYs are generated at a rate slower than the incoming data burst period. Another example is if a complete frame is received before the end of displaying the current frame. In this case the incoming data packet, which represents a third frame, is not read from the FIFO 128 by the HDMD FB until the conclusion of the display of the current frame.

The Ready queue 132 also issues the HPPI CONNECT signal in response to a REQUEST from the attached transmitter.

Eleven bit counters CNT1 134*a* and CNT2 134*b* are maintained by the FIFO WRITE CNTR 130 to tag a last pixel of a scan line and a last line in a frame of the incoming image. These tags are written directly into the FIFO 128, with the corresponding pixels. The output TAG bits form the aforementioned TAG bus used by the FBA CNTR 40 and FBB CNTR 42 to synchronize display buffer switching with the end of an SVS frame, and to reset the HADDR counter 60 and the VADDR counter 62 (FIG. 12). The counters 134*a* and 134*b* are initialized by the SVS at the beginning of a packet transfer, as described below.

As was detailed above, the data format for the HDMD 10 is an extension of the HPPI data format protocol. The HPPI protocol specifies that there be a six word Header followed by data. In addition, the system of the invention defines a packet format such that four words of the Header data contain information concerning the incoming frame (FIG. 12*d*). Thus, these four words, along with the six words defined by the HPPI protocol, comprise the modified HPPI Header.

The HSI 26 also includes a HPPI transmitter 136, which is constructed in accordance with ANSI specifications X3T9.3/89-013 and X3T9.3/88-023. HPPI transmitter 136 receives HDTV OUT data from the HDTI 28, using a data format described below. Transmitter 136 also receives HDTV vertical and horizontal synchronization signals (VS and HS) which are used to generate HPPI signals, REQUEST, PACKET and BURST. HPPIOUT CLKGEN 138 generates HPP CLK which is used for strobing HDTV sampled data into the HPPI transmitter 136, with a LLRC code, and transmitted to the receiver of the HDTV data, such as the SVS 12.

HDTVI 28

Figure 21:
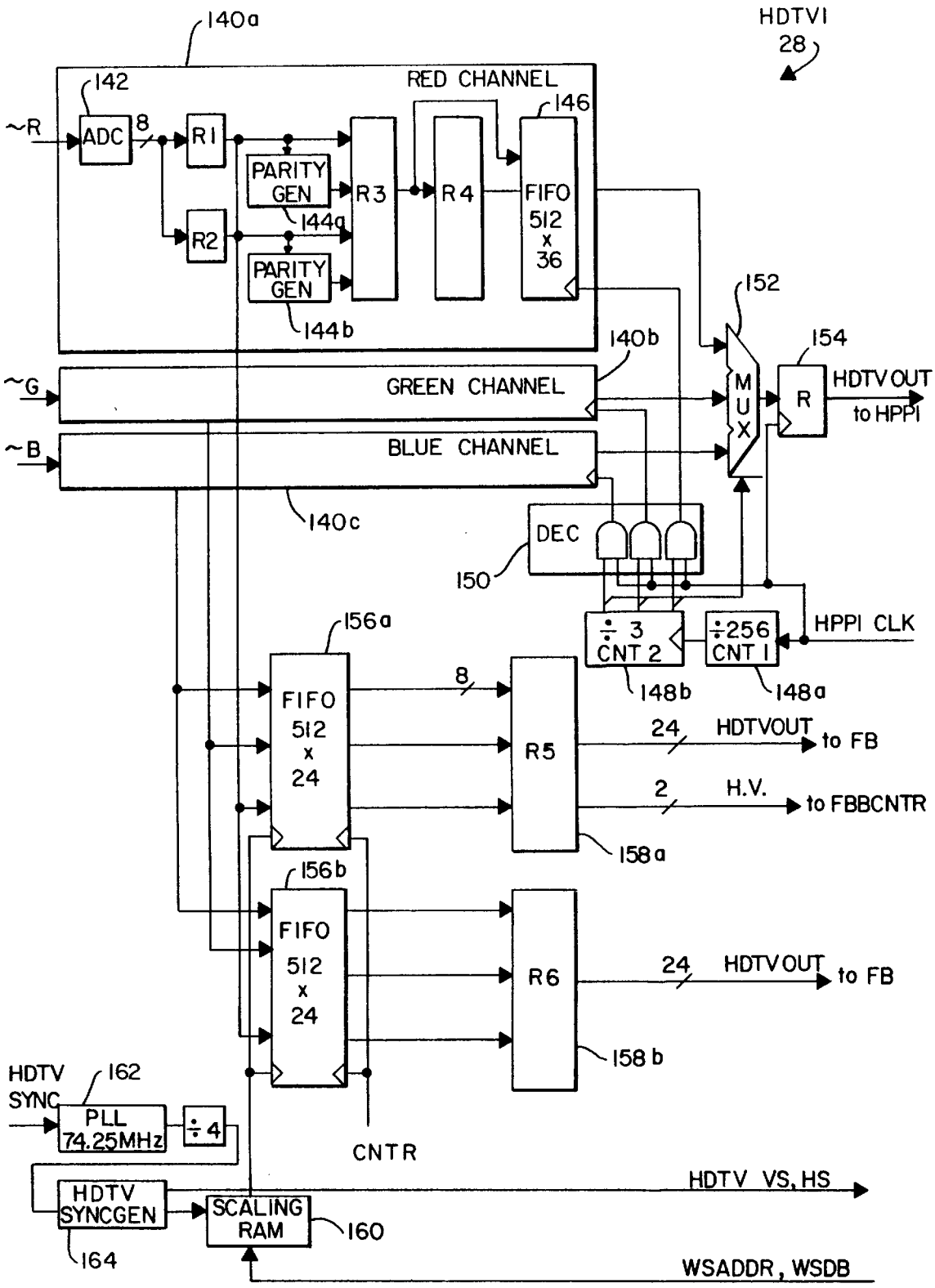
FIG. 21 illustrates a HDTV interface which provides digitization of a full color, full motion HDTV image in real time; and buffers this data for transfer to the FB and to the HSI.

The HDTVI 28, seen in FIG. 21, provides digitization of a full color, full motion 1125/60 Hz HDTV image in real time and buffers this data for transfer to the FB and to the HSI 26. HDTV inputs and timing correspond, by example, to the SMPTE 240 M High Definition Television Standard, but are not limited to only this one particular format.

The HDTVI 28 includes three red, green and blue sampling channels 140*a*, 140*b*, and 140*c*, respectively. The red channel 140*a* is represented on FIG. 21 in detail. The analog red signal is sampled at 74.25 MHz by an analog-to-digital converter ADC 142, which generates 8-bit pixel values. The ADC 142 output is demultiplexed into two registers R1 and R2, which also store the outputs of Parity Generator blocks 144*a* and 144*b*. Registers R3 and R4 accumulate four consecutive bytes (32-bits), and four corresponding parity bits, and load this data in parallel to a 512 word by 36-bit FIFO 146.

The outputs of the red, blue, and green channels 140*a*–140*c* are combined in 256, 36-bit word bursts by means of counters CNT1 148*a* and CNT2 148*b*, a decoder 150, and a MUX 152. CNT1 148*a* divides the HPPI CLK by 256 and CNT2 148*b* divides the output of CNT1 by three. The outputs of three gates of the decoder DEC 150 provide three sequences of 256 pulses, which are used in turn as red, green and blue FIFO 146 read-out signals. The outputs of counter CNT2 148*b* control MUX 152. The HPPI clock signal loads data from the MUX 152 output to the output register R 154. The R 154 output provides 256 words representing 1024 8-bit pixels of Red, then 256 words representing 1024 8-bit pixels of Green, then 256 words representing 1024 8-bit pixels of Blue to the HSI 26. The HPPI transmitter 136 transmits the digitized HDTV R,G,B format video data to an external video processor or storage device. For example, the SVS 12 receives 1024 pixels of one active line of sampled HDTV data as three bursts, each burst having 256 words.

In that the HDTV data rate is approximately 195 MByte/sec a 32-bit HPPI interface, with a transmission rate 100 MByte/sec, is sufficient to transmit about half of the HDTV lines to the receiver. This is adequate for applications where two images, an original HDTV image and a SVS-processed image, are shown on the same monitor 18. However, if the full size HDTV image is to be externally processed, a 64-bit HPPI channel, with a data rate of 200 MByte/sec, is employed. This requires assembling 8-pixel words by using 72 bit wide FIFO's for the FIFOs 146. In this case, three 64-bit HPPI bursts represent a single line of HDTV data, where the HDTV line is considered as having 2048 pixels, but the last 128 pixels of the line do not represent the image.

A second portion of the HDTVI 28 includes two FIFOs 156*a* and 156*b*, each storing 512 words by 24-bits. The FIFOs 156*a* and 156*b* output two 24-bit HDTV pixels in parallel to the FB data bus. The output registers R5 158*a* and R6 158*b* function as a pipeline between the FIFOs 156*a* and 156*b*, respectively, and the FB data bus, HDTVOUT.

Gating of the FIFO 156*a* and 156*b* write clock is used as a mechanism for scaling the HDTV image in real time. A SCALING RAM 160 is employed for this purpose. In this technique, a pair of fast static RAMs comprise the scaling RAM 160 and produce a bit mask for each pixel in a line, and for each line in the HDTV raster, to enable or disable the FIFO 156 write clock for a specific pixel. When a pixel is enabled both horizontally and vertically the pixel is written to the FIFO 156, else it is discarded. An HDTV image may also be scaled by an external processor and sent back to the HDMD FB to be compared with the original image. The same scaling mechanism may be used to scale the HDTV digitized data sent to an external video processor via the HSI 26, although the resulting image degradation may be objectionable for further processing.

FIG. 21 also shows a Phase-locked loop 162 that locks the 74.25 MHz sample clock to the incoming HDTV sync, and also to a HDTV SYNCGEN generator 164. The HDTV SYNCGEN 164 generates timing pulses for the HDMD 10 monitor 18 when working in HDTV mode, and is built analogously to the SYNCGEN 24*a* of VIDB 24. In addition, horizontal and vertical raster information is written into the FIFOs 156*a* and 156*b* as a pair of tag bits referred to H and V. These bits are used by the WS 16 to decode end-of-line and end-of-frame conditions for the HDTV raster, when mixing HDTV input with SVS input. As a result, the output image is genlocked with the incoming image, which is required when using the HDMD 10 in, for example, an HDTV broadcasting or production studio.

It should be realized that a number of modifications to the above teaching may occur to those skilled in the art. For example, another high speed communication bus protocol may be selected for coupling to the HSI 26, with corresponding changes being made to the circuitry of the HSI 26 and to the organization and interpretation of the received image data. Also by example, the system taught by the invention is not restricted for use only with supercomputer and/or HDTV generated video data, in that other sources of image data and other embodiments of image data processors may be employed. Also each color of the R,G,B video data may be expressed with other than eight bits.

Thus, while the invention has been particularly shown and described with respect to a preferred embodiment thereof, it will be understood by those skilled in the art that changes in form and details may be made therein without departing from the scope and spirit of the invention.

Having thus described our invention, what we claim as new, and desire to secure by Letters Patent is:

1. Image display apparatus, comprising:

image display control means for programmably generating image display control signals;

image buffer means having a plurality of addressable locations for storing image pixel data, said image buffer means having an output for coupling the stored image pixel data to an input of an image display means having a display screen, said image buffer means being configurable for both image pixel data write and image pixel data read accesses into one of a plurality of different x storage location by y storage location by z-bit configurations;

means, having an input coupled to said output of said image buffer means, for converting image pixel data read from said image buffer means to electrical signals for driving the input of the image display means, said converting means including means, responsive to control signals generated by said image display control means, for generating one of a plurality of different timing formats for the electrical signals, wherein a generated one of the plurality of different timing formats is selected as a function of a display resolution of the image display means; and means, responsive to control signals generated by said image display control means, for configuring said image buffer means for both image pixel data write and image pixel data read accesses into one of said plurality of different x storage location by y storage location by z-bit configurations.

2. Image display apparatus as set forth in claim 1 wherein said configuring means is responsive to control signals generated by said image display control means for configuring said image buffer means as two, 2048 location by 1024 location by 24-bit buffers and one 2048 location by 1024 location by 16-bit buffer; or as two, 2048 location by 2048 location by 24-bit buffers and one 2048 location by 2048 location by 16-bit buffer; or as four, 2048 location by 1024 location by 24-bit buffers and two 2048 location by 1024 location by 16-bit buffers.

3. Image display apparatus as set forth in claim 2 wherein the 24-bit buffers each store R,G,B pixel data, and wherein the 16-bit buffers each store a color index (CI) value and an associated window identifier (WID) value.

4. Image display apparatus as set forth in claim 3 wherein said converting means includes means for decoding a CI value and an associated WID value, output from said image buffer means, for providing R,G,B pixel data at an output of the decoding means.

5. Image display apparatus as set forth in claim 1 and further comprising:

first interface means having an input for receiving image pixel data expressed in a first format and having an output coupled to said image buffer means for storing the received image pixel data in said image buffer means in a R,G,B format;

second interface means having an input for receiving image pixel data expressed in a second format and having an output coupled to said image buffer means for storing the received image pixel data in said image buffer means in the R,G,B format; and third interface means having an input for receiving image pixel data expressed in the CI and WID a Color Index (CI) and Window Identifier (WID) format and having an output coupled to said image buffer means for storing the received image pixel data in said image buffer means in the CI and WID format.

6. Image display apparatus as set forth in claim 5 wherein said converting means includes means for decoding a CI value and an associated WID value that is output from said image buffer means for providing R,G,B pixel data at an output of the decoding means, and wherein the decoding means further decodes the CI value and the associated WID value to provide a key signal specifying, for an associated image pixel, a contribution of the R,G,B data from the first interface means, a contribution of the R,G,B data from the second interface means, and a contribution of the R,G,B, data output by the decoding means.

7. Image display apparatus as set forth in claim 5 wherein said first interface means includes means for coupling to a communications bus for receiving the image pixel data therefrom, and wherein the communications bus transfers image pixel data to the first interface means in a raster scan order.

8. Image display apparatus as set forth in claim 7 wherein the communications bus further transfers information to the first interface means for specifying coordinates of an initial display screen location of the image pixel data, and wherein said first interface means includes means for causing said image buffer means to store the image pixel data beginning at an addressable location that corresponds to the coordinate specifying information.

9. Image display apparatus as set forth in claim 5 wherein said second interface means includes means for coupling to a source of a High Definition Television (HDTV) signal, said coupling means including means for converting the HDTV signal to the R,G,B format.

10. Image display apparatus, comprising:

image buffer means having a plurality of addressable locations for storing image pixel data, said image buffer means being configurable for both image pixel data write and image pixel data read accesses into one of a plurality of different x storage location by y storage location by z-bit configurations;

means, having an input coupled to an output of said image buffer means, for converting image pixel data read therefrom to electrical signals suitable for driving an image display means so as to display the image pixels;

first interface means having an input for receiving an image signal expressed in a first format and having an output coupled to said image buffer means for storing the received image signal therein;

second interface means having an input for receiving an image signal expressed in a second format and having an output coupled to said image buffer means for storing the received image signal therein; and third interface means having an input for receiving an image signal expressed in a third format and having an output coupled to said image buffer means for storing the received image signal therein; wherein the image signal stored from said third interface means includes information for specifying, for each displayed image pixel, a contribution from the image signal received by each of the first interface means, the second interface means, and the third interface means.

11. Image display apparatus as set forth in claim 10 wherein said converting means includes means for generating a plurality of different timing formats for the electrical signals for driving image display means having different display resolutions.

12. Image display apparatus as set forth in claim 10 wherein said first interface means includes means for coupling to a communications bus for receiving the image signal expressed in the first format therefrom.

13. Image display apparatus as set forth in claim 12 wherein the communications bus transfers image pixel data to the first interface means in a raster scan order.

14. Image display apparatus as set forth in claim 13 wherein the communications bus further transfers information to the first interface means for specifying coordinates of an initial display screen location of the image pixel data, and wherein said first interface means includes means for causing said image buffer means to store the image pixel data beginning at an addressable location that corresponds to the coordinate specifying information.

15. Image display apparatus as set forth in claim 12 wherein the communications bus operates in accordance with an electrical specification known as a High Performance Parallel Interface (HPPI).

16. Image display apparatus as set forth in claim 10 wherein said second interface means includes means for coupling to a source of a High Definition Television (HDTV) signal, said coupling means including means for converting the HDTV signal to a R,G,B digital signal prior to the storage of the received image signal within said image buffer means.

17. Image display apparatus as set forth in claim 16 wherein said coupling means further includes means for coupling the converted HDTV signal to means for transmitting the converted HDTV signal to a communications bus.

18. Image display apparatus as set forth in claim 17 wherein said first interface means includes means for coupling to a communications bus for receiving the image signal expressed in the first format therefrom, and wherein the transmitted converted HDTV signal is received by means external to the image display apparatus and is subsequently transmitted from the external means to the first interface means for reception thereby.

19. Image display apparatus as set forth in claim 10 wherein the first format is a R,G,B format, wherein said second interface means includes means for coupling to a source of a High Definition Television (HDTV) signal, and wherein said second interface means includes means for converting the HDTV signal to the first format prior to the storage of the received image signal within said image buffer means.

20. Image display apparatus as set forth in claim 10 wherein the first format is a R,G,B format, wherein the third format includes information for specifying a color index, and wherein said converting means includes means for converting the color index to the first format.

21. Image display apparatus as set forth in claim 10 wherein the first format is a R,G,B format, wherein second interface means includes means for converting the received image signal to the R,G,B format prior to the storage of the received image signal within said image buffer means, wherein the third format includes information for specifying a color index (CI) and an image display means display screen window identifier (WID), wherein said image buffer means is partitioned into a first buffer means for storing pixel data that specifies two colors of the R,G,B format, and wherein said image buffer means is partitioned into a second buffer means for storing a third color of the R,G,B format and also for storing the information specifying the CI and the WID.

22. Image display apparatus as set forth in claim 21 wherein said converting means includes means for decoding a CI value and an associated WID value, read from the second buffer means, for providing R,G,B pixel data at an output of the decoding means.

23. Image display apparatus as set forth in claim 22 wherein the decoding means further decodes the CI value and the associated WID value to provide a key signal specifying, for an associated image pixel, a contribution of the R,G,B data from the first interface means, a contribution of the R,G,B data from the second interface means, and a contribution of the R,G,B, data output by the decoding means.

24. Image display apparatus as set forth in claim 10 wherein the first format is a R,G,B format, wherein second interface means includes means for converting the received image signal to the R,G,B format prior to the storage of the received image signal within said image buffer means, wherein the third format includes information for specifying a color index (CI) and an image display means display screen window identifier (WID), and further including means, having outputs coupled to said image buffer means, for configuring said image buffer means as two, 2048 location by 1024 location by 24-bit buffers and one 2048 location by 1024 location by 16-bit buffer; or as two, 2048 location by 2048 location by 24-bit buffers and one 2048 location by 2048 location by 16-bit buffer; or as four, 2048 location by 1024 location by 24-bit buffers and two 2048 location by 1024 location by 16-bit buffers; wherein the 24-bit buffers store R,G,B pixel data and the 16-bit buffers store the CI and the WID data.

25. Image display apparatus, comprising:

image display control means for programmably generating image display control signals;

image buffer means having a plurality of addressable locations for storing image pixel data;

means, having an input coupled to an output of said image buffer means, for converting image pixel data output therefrom to electrical signals for driving an image display means so as to display image pixels, said converting means including means, responsive to control signals generated by said image display control means, for generating one of a plurality of different timing formats for the electrical signals for driving an image display means having a specified display resolution; and means, responsive to control signals generated by said image display control means, for configuring said image buffer means for both image pixel data write and image pixel data read accesses as a function of the specified display resolution; wherein said image buffer means is configured as two, 2048 location by 1024 location by 24-bit buffers and one 2048 location by 1024 location by 16-bit buffer; or as two, 2048 location by 2048 location by 24-bit buffers and one 2048 location by 2048 location by 16-bit buffer; or as four, 2048 location by 1024 location by 24-bit buffers and two 2048 location by 1024 location by 16-bit buffers.

26. Image display apparatus as set forth in claim 25 wherein the 24-bit buffers each store R,G,B pixel data and wherein the 16-bit buffers each store a color index (CI) value and an associated window identifier (WID) value.

27. Image display apparatus as set forth in claim 26 wherein said converting means includes means for decoding a CI value and an associated WID value, read from said image buffer means, for providing R,G,B pixel data at an output of the decoding means.

28. Image display apparatus as set forth in claim 27 wherein the decoding means further decodes the CI value and the associated WID value to provide a key signal specifying, for an associated image pixel, a contribution of the R,G,B data from each of the 24-bit buffers and a contribution of the R,G,B, data output by the decoding means.

29. Image display apparatus as set forth in claim 25 and further including means for receiving, from a communications channel, image pixel data therefrom, and further including means, having an input coupled to an output of the receiving means, and an output coupled to the image buffer means, for providing the image pixel data for storage within at least one of the 24-bit buffers.

30. Image display apparatus as set forth in claim 29, wherein said communications channel further transfers information for specifying coordinates of an initial display screen location of the image pixel data, and wherein said apparatus further includes interface means, responsive to said coordinate specifying information, for causing said image buffer means to store the image pixel data beginning at an addressable location that corresponds to the coordinate specifying information.

31. Image display apparatus as set forth in claim 25 and further including means for coupling to a source of a High Definition Television (HDTV) signal, said coupling means including means for converting the HDTV signal to image pixel data, and further including means, having an input coupled to an output of the coupling means, and an output coupled to the image buffer means, for providing the image pixel data for storage within at least one of the 24-bit buffers.

32. Image display apparatus as set forth in claim 31, and further including means for interfacing to the image display control means for receiving from said image display control means information for specifying coordinates of an initial display screen location of the image pixel data, and including interface means, responsive to said coordinate specifying information, for causing said image buffer means to store the image pixel data beginning at an addressable location that corresponds to the coordinate specifying information.

33. Image display apparatus, comprising:

image display control means for programmably generating image display control signals;

image buffer means having a plurality of addressable locations for storing image pixel data, said image buffer means having an output for coupling the stored image pixel data to an input of an image display means having a display screen, said image buffer means being configurable for both image pixel data write and image data pixel read accesses into one of a plurality of different x storage location by y storage location by z-bit configurations;

means, having an input coupled to said output of said image buffer means, for converting image pixel data read from said image buffer means to electrical signals for driving the input of the image display means; and means, responsive to control signals generated by said image display control means, for configuring said image buffer means for both image pixel data write and image pixel data read accesses into one of said plurality of different x storage location by y storage location by z-bit configurations, wherein one of said configurations corresponds to a stereoscopic image display configuration.

* * * * *